United States Patent [19]

Fleishman

[11] Patent Number: 4,551,960

[45] Date of Patent: Nov. 12, 1985

[54] SPACE FRAME STRUCTURAL SYSTEM

[76] Inventor: Gregg R. Fleishman, 6071 Hargis St., Los Angeles, Calif. 90034

[21] Appl. No.: 466,102

[22] Filed: Feb. 14, 1983

[51] Int. Cl.[4] ..... E04H 12/00

[52] U.S. Cl. ..... 52/648; 403/172; 403/176; 426/126

[58] Field of Search ..... 52/80, 81, 648; 403/171, 172, 176, 346, 347, 354; 426/120, 121, 126

[56] References Cited

U.S. PATENT DOCUMENTS

| | | | |
|---|---|---|---|
| 1,124,526 | 1/1915 | Richter | 446/126 |
| 1,718,230 | 6/1929 | Graves | 446/126 |
| 1,866,176 | 7/1932 | Schmidt | 466/120 |
| 2,783,046 | 2/1957 | Lien | 446/126 |
| 2,868,568 | 1/1959 | Frye | 403/171 |
| 3,399,914 | 9/1968 | Grant | 52/648 |
| 3,861,107 | 1/1975 | Papayoti | 52/648 |
| 3,914,063 | 10/1975 | Papayoti | 52/648 |
| 4,065,220 | 12/1977 | Ruga | 403/176 |
| 4,332,501 | 6/1982 | Slysh | 52/648 |
| 4,406,562 | 9/1983 | Nasi | 403/347 |

FOREIGN PATENT DOCUMENTS

| | | | |
|---|---|---|---|
| 540788 | 3/1956 | Italy | 403/171 |

*Primary Examiner*—Henry E. Raduazo
*Attorney, Agent, or Firm*—Robert J. Schaap

[57] ABSTRACT

A structural system and method which utilizes a plurality of three dimensional nodal connectors and one or more struts extending between and secured to the nodal connectors. Each connector is comprised of at least three relatively flat planar plates and preferably, three pairs of relatively flat planar plates which are assembled in three mutually perpendicular planes in space. Each of these plates in each of the three pairs are substantially similar in both size and shape and are uniquely designed so that they are capable of being interfitted in the mutually perpendicular planes. Also each of the struts are substantially similar in both size and shape and may be connected to the nodal connectors at connection regions which are slightly resilient so that the struts are capable of being snap fitted between such plates of each connector and releaseably retained therein.

41 Claims, 38 Drawing Figures

FIG. 4
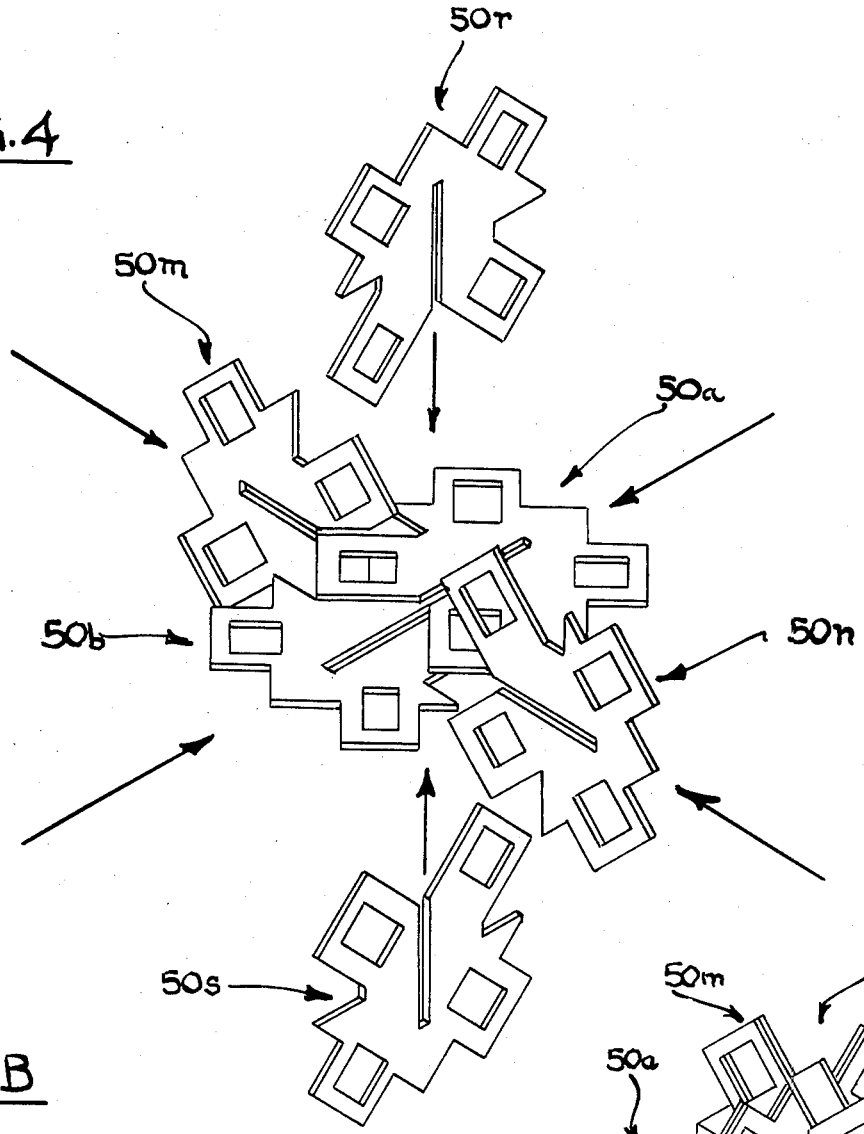
FIG. 3B
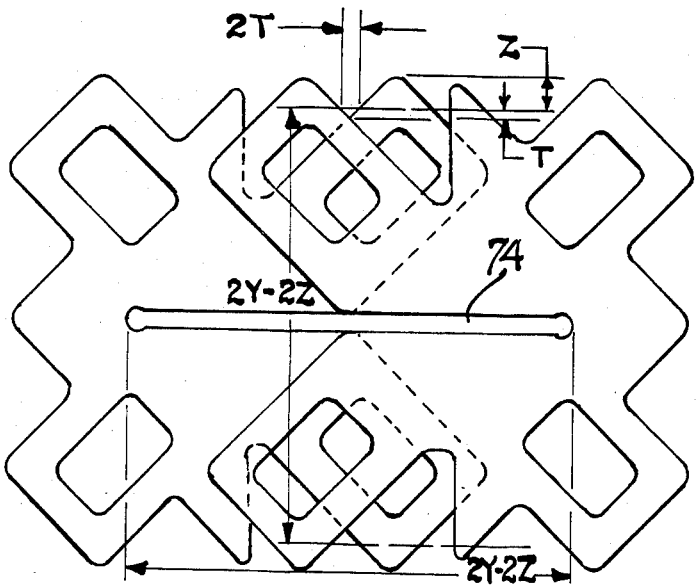
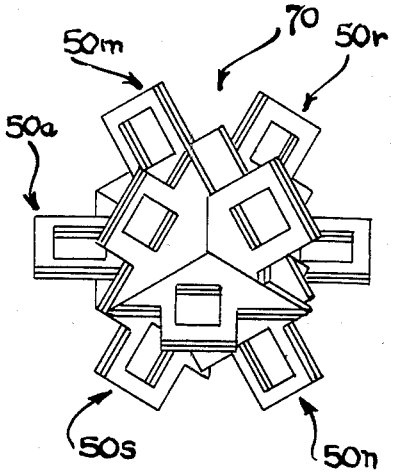
FIG. 5

SPACE FRAME STRUCTURAL SYSTEM

BACKGROUND OF THE INVENTION

1. Field of the Invention

This invention relates in general to certain new and useful improvements in structural systems, and more particularly, to space frame structural systems which utilize nodal connectors comprised of a plurality of substantially identically sized and shaped, mutually perpendicular, interfitted plates.

2. Brief Description of the Prior Art

The prior art is replete with a variety of structural systems using various types of structural nodes or connectors and various types of struts or beams which extend between and connect the structural nodes. One of the principle problems attendant to these various structural systems utilizing struts and the associated connecting nodes is the fact that there is no universality in the nodes or in the struts. Thus, substitution of one type of strut for another or substitution of one type of node for another in a structural system is not possible. Further, there is no universality in the means for connecting the struts to the nodes.

A further substantial problem in connection with the prior art structural systems was the fact that each structural node was comprised of a plurality of differently sized and differently shaped plates. This not only increased the cost of manufacture, but also substantially increased the difficulty in assembly.

Another significant problem with the prior art struts and structural nodal connectors is the fact that very specialized types of mechanical fasteners were required to connect the struts to the connectors. The mere fact that connectors were required substantially increased the amount of time for construction of the system and further substantially reduce the versatility of the system. In other words, there was no automatic connection or semi-automatic type connection between the struts and the connector nodes.

U.S. Pat. No. 2,868,568 to R. P. Frye discloses a connector referred to as a "knock-down structure" capable of being used as a nodal connector in a structural system. The Frye knock-down structure utilizes two pairs of similar plates and a pair of third plates which are dis-similar to the first two pairs. Thus, Frye cannot construct a node from all commonly sized and shaped plates or brackets. Frye must flex struts to enable connection to a node which inherently affects the rigidity of the system. Further, there is nothing to prevent rotation of a strut when connected to a node.

U.S. Pat. No. 4,308,698 to Gregg R. Fleishman also discloses nodal connectors or joints and a means for connecting struts to those joints by utilizing a unique interlocking arrangement between the joint and the strut. However, each joint is comprised of a single plate and struts are effectively connected in the single plate. Further, the plates and joints are connected to form a space enclosing geodesic dome like structure as opposed to as space frame structure.

U.S. Pat. No. 4,065,220 to Wayne Ruga also discloses a structural system utilizing tubular struts and a joint or a nodal connector. In this case, the tubular struts are adapated to fit into slots formed in the joint or node. However, Ruga must provide a large assortment of brackets and select from this large assortment of brackets to form a plurality of different node constructions. Also, there is no fastening means provided for locking the assembled components in the assembled relationship.

OBJECTS OF THE INVENTION

It is, therefore, a primary object of the present invention to provide a three dimensional nodal connector for securing one or more struts extending from the nodal connector and where the nodal connector is comprised of a plurality of similarly sized and shaped plates connected in a desired relationship.

It is another object of the present invention to provide a nodal connector of the type stated in which pairs of relatively flat, planar plates are connected in at least three mutually perpendicular planes in order to form a spatial three-dimensional nodal connector.

It is a further object of the present invention to provide a three dimensional nodal connector of the type stated which is sufficiently rigid in its construction to serve as a structural node and which has a somewhat resilient portion capable of having a strut retentively but nevertheless releaseably snap-fitted thereto.

It is an additional object of the present invention to provide a structural node of the type stated providing at least twelve connector regions which results in generally octahedral constructions.

It is also an object of the present invention to provide a space frame structural system comprised of at least two spaced apart nodal connectors and at least one strut extending between each of said connectors and which system utilizes nodal connectors and struts of the type stated so that the struts are capable of being snap-fitted between two parallel plates of the nodal connectors.

It is still a further object of the present invention to provide a structural system of the type stated in which the struts are connected to each nodal connector in a snap fitting arrangement for retentively, but nevertheless releaseably retaining the struts in nodal connectors.

It is still another object of the present invention to provide a relatively flat bracket forming part of a structural node and in which a plurality of substantially identically sized and shaped brackets are assembled to form said node without independent mechanical fasteners.

It is still an additional object of the present invention provide a split strut system utilizing a pair of cooperating struts which extend between a pair of nodal connectors and which permits connection and dis-connection without displacement of the nodal connectors.

It is another salient object of the present invention to provide a method of constructing a structural support comprised of a plurality of nodal connectors and a plurality of struts and in which the struts are connected to each of the nodal connectors in an arrangement whereby the struts can be releaseably attached to the nodal connectors.

With the above and other objects in view, my invention resides in the novel features of form, construction, arrangement and combination of parts presently described and pointed out in the claims.

BRIEF SUMMARY OF THE DISCLOSURE

A system having a plurality of a relatively flat and somewhat resiliently bendable brackets which are capable of being assembled to provide a three dimensional structural node or so-called "nodal connector". A plurality of these nodal connectors are arranged so that one or more struts are connected to and extend between the nodal connectors to create a structural system.

The brackets are relatively flat planar plates with opposite initially relatively flat surfaces. The system utilizes at least three relatively flat planar plates which are substantially identical in size and shape. Each of these plates are provided with means to enable interfitting engagement in substantially mutually perpendicular planes in space to thereby form a three dimensional nodal connector.

In a more preferred embodiment, the nodal connector is comprised of three pairs of plates and the plates of each of the pairs are assembled in facewise parallel disposition in the nodal connector. The plates of the first pair are capable of being assembled with respect to the second pair in perpendicular relationship to the second pair and the plates of the third pair are capable of being connected to the first and second pairs of plates in substantially mutually perpendicular planes with respect to each of the first and second pairs of plates.

Each of the plates provides four generally quadrilaterally located connection regions and also, each pair of the three pairs of plates forms four generally quadrilaterally located connection regions. The nodal connector thus formed is a centrally solid or rigid connector and has somewhat resilient areas in the connection regions. In this way, struts can be connected to the nodal connector in at least twelve connection regions.

Each of the pairs of plates are provided with connecting means so that a strut extending to a nodal connector is capable of being snap fitted between the parallel plates in a pair of that connector. Thus, the connecting strut is retentively, but nevertheless releasably retained between the pairs of plates. The connection of the strut occurs between pairs of the plates at the quadrilaterally located connection regions.

For a generally octahedral shaped space frame, the struts are connected to each structural node in the plane of one pair of plates and at a 45 degree angle relative to the planes of the other two pairs of plates. It is also possible to connect the struts in perpendicular arrangement in space relative to one another as hereinafter described in more detail.

Each of the brackets exists in the form of a relatively flat plate, as aforesaid, and where each plate has an elongate slot defined by a longitudinal center-line. The slot opens at one edge of each of the plates and has an innermost end spaced from that edge of the plate. Each of the plates has a pair of outwardly diverging edges which extend outwardly from the longitudinal center-line at substantially equal angles with respect to that longitudinal center-line. Each of the diverging edges have innermost ends proximate to the slot and are substantially equidistantly spaced from the longitudinal center-line. Longitudinally extending edges project rearwardly from the innermost ends of the diverging edges. Further, each of the diverging edges have outermost ends distal to the slot and are substantially equidistantly spaced from the longitudinal center-line.

In a more preferred embodiment, the distance (X) between a transverse center-line of the plate to a plane passing through the innermost end of the slot is approximately equal to the distance (X) between the longitudinal edges to the longitudinal center-line. Further, the distance between the outermost ends of each of the diverging edges to the longitudinal center-line (Y) is equal to the distance between the outermost ends to a plane passing through the innermost end of the slot plus T where T is the thickness of a plate. This unique system of brackets is capable of forming a number of different but yet common nodal connectors. Due to the fact that the brackets forming each of the connectors are substantially identical both in size and shape, cost of manufacture is substantially reduced. Further, the unique size and shape of the various brackets permit easy and very rapid assembly and dis-assembly of the nodal connectors.

This invention possesses many other advantages and has other purposes which may be made more clearly apparent from a consideration of the forms in which it may be embodied. These forms are shown in the drawings forming part of and accompanying the present specification. They will now be described in detail for the purposes of illustrating the general principles of the invention, but it is to be understood that such detailed descriptions are not to be taken in a limiting sense.

BRIEF DESCRIPTION OF THE DRAWINGS

Figure 1:
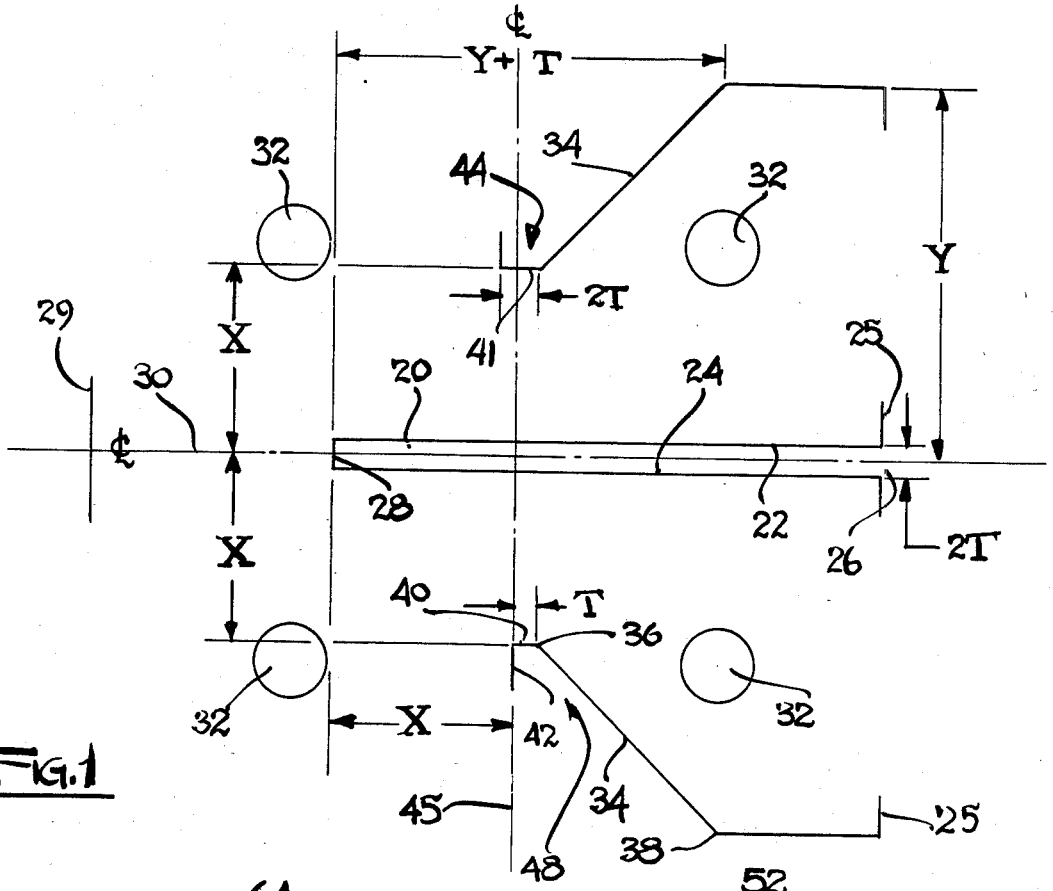
Figure 2:
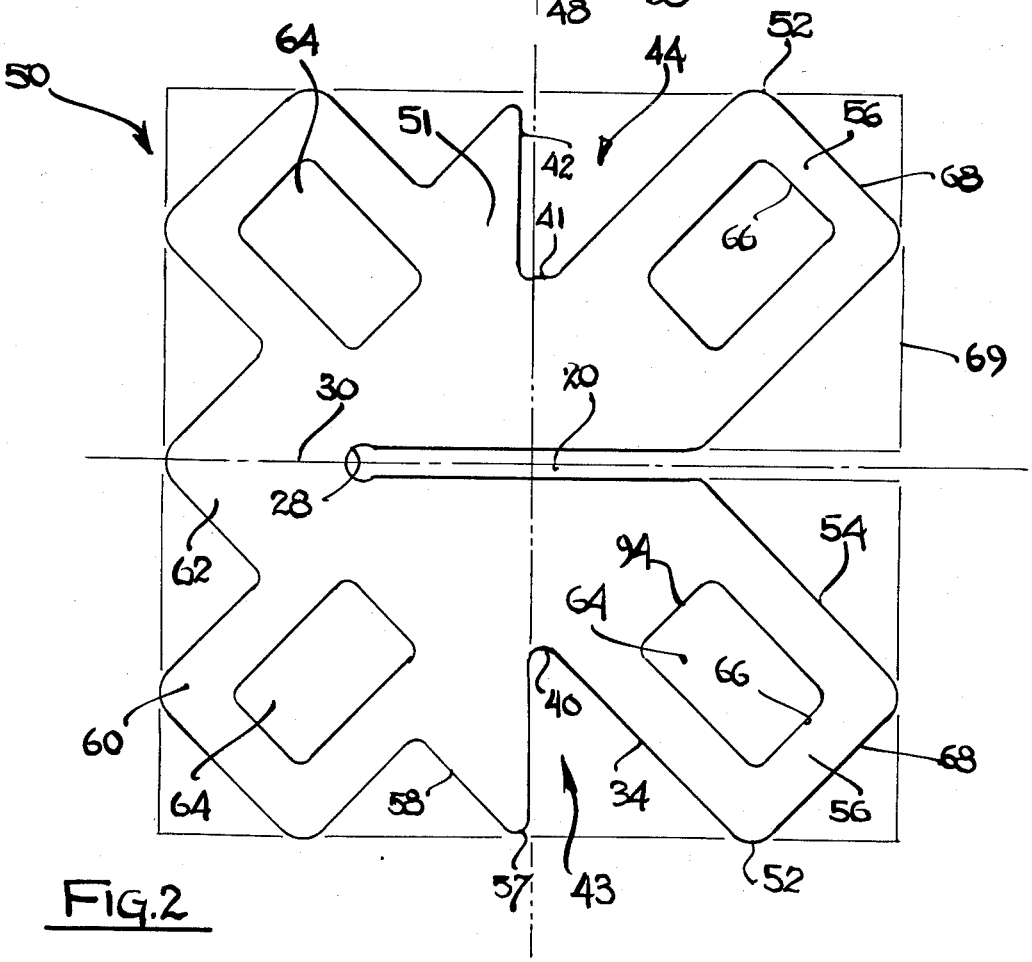
Figure 3:
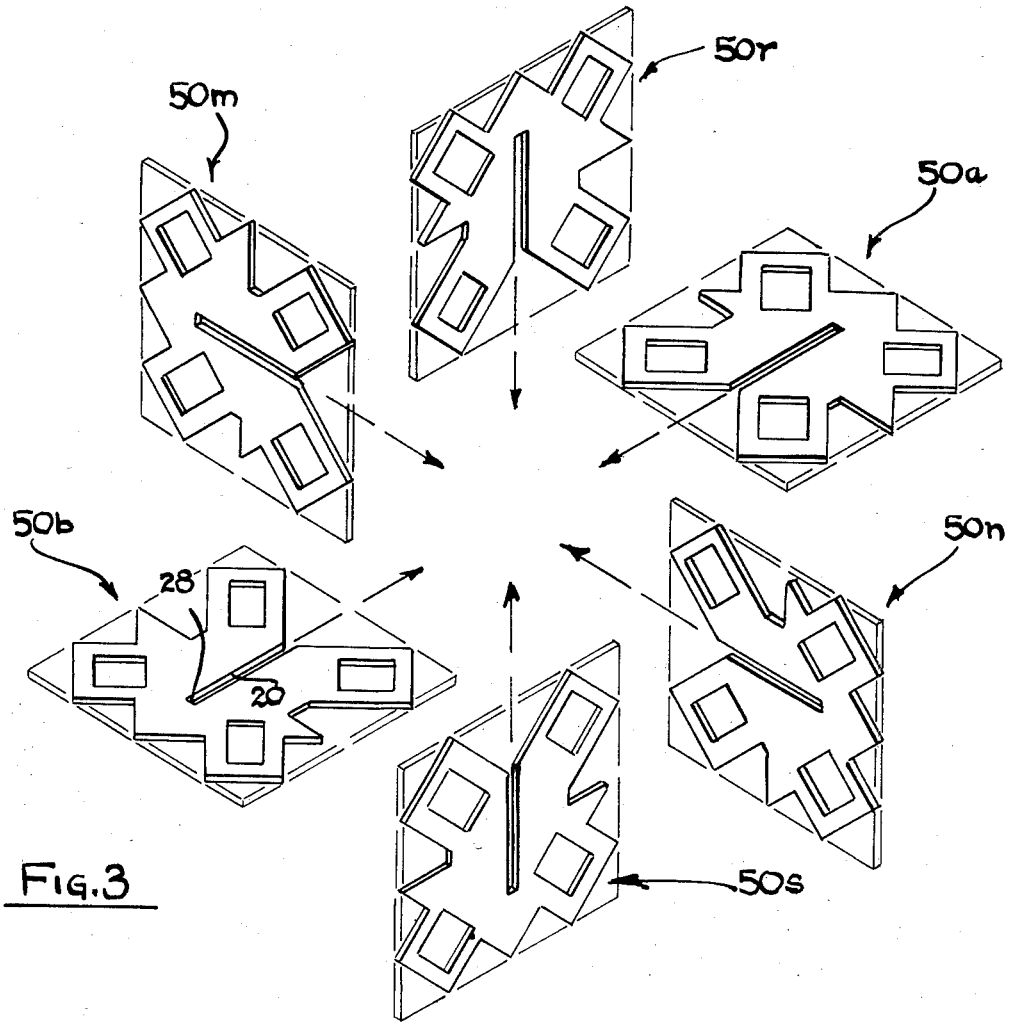
Figure 3A:
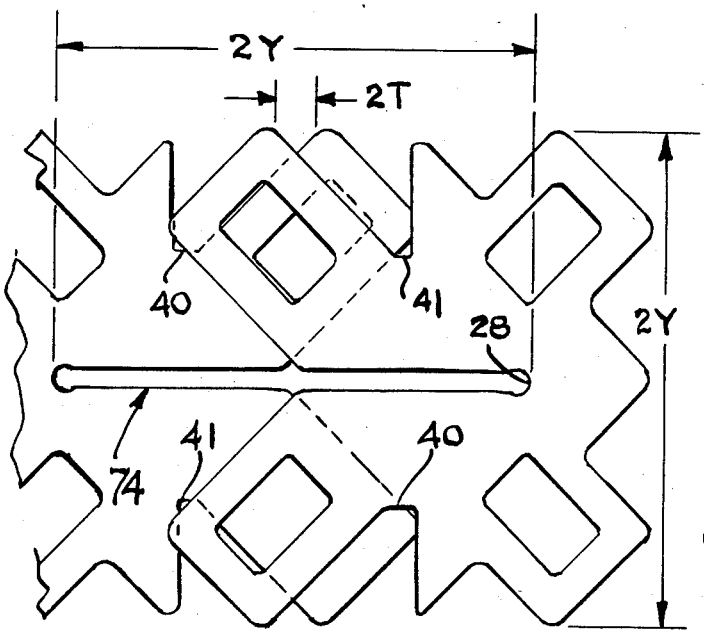
Figure 3C:
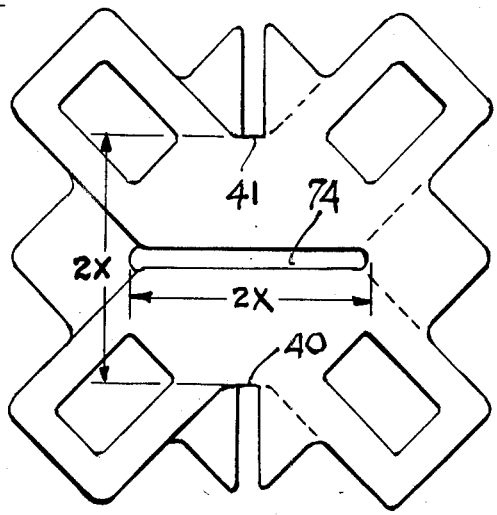
Figure 6C:
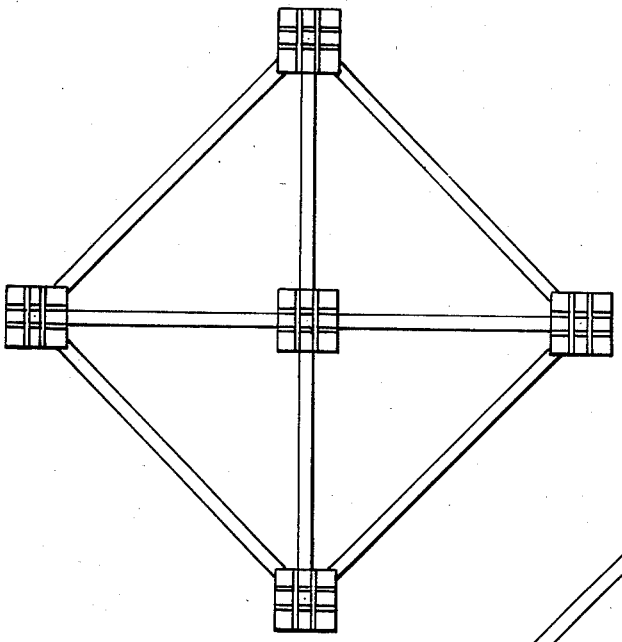
Figure 6B:
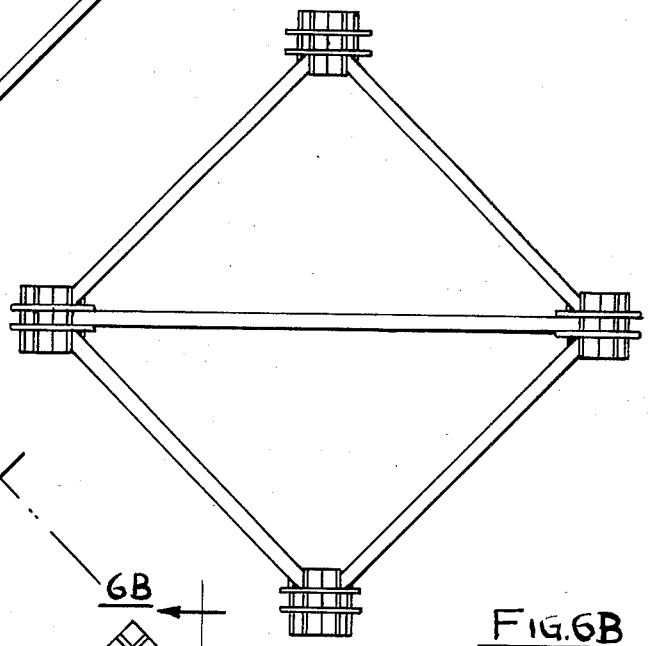
Figure 6A:
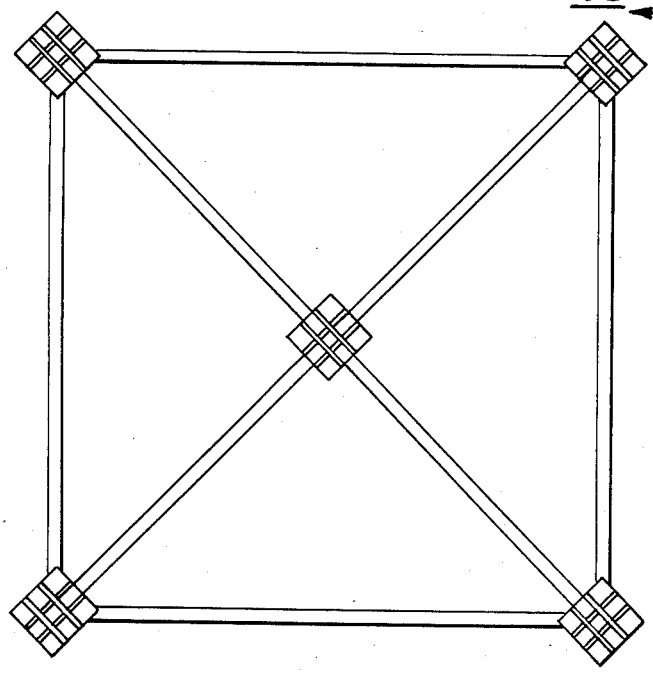
Figure 7:
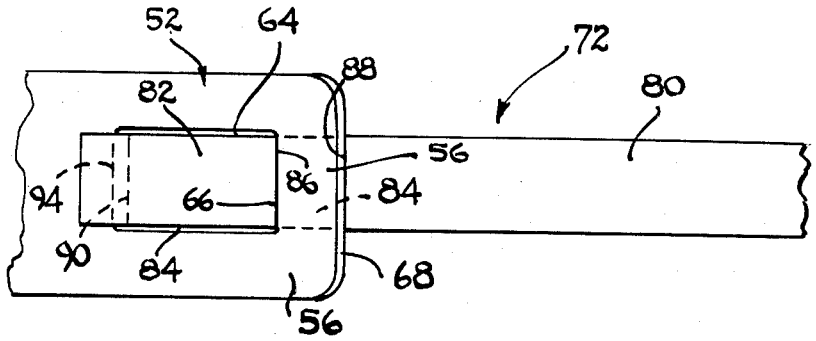
Figure 8:
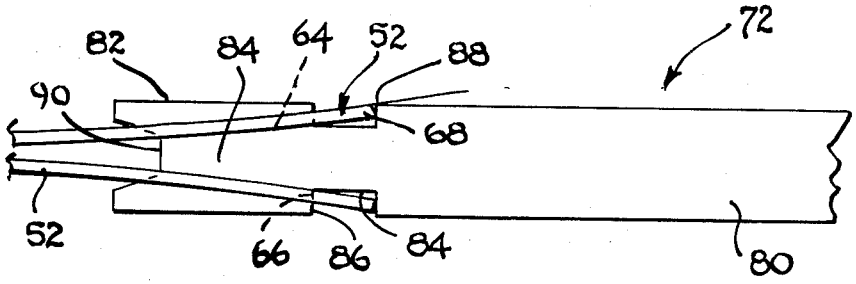
Figure 9:
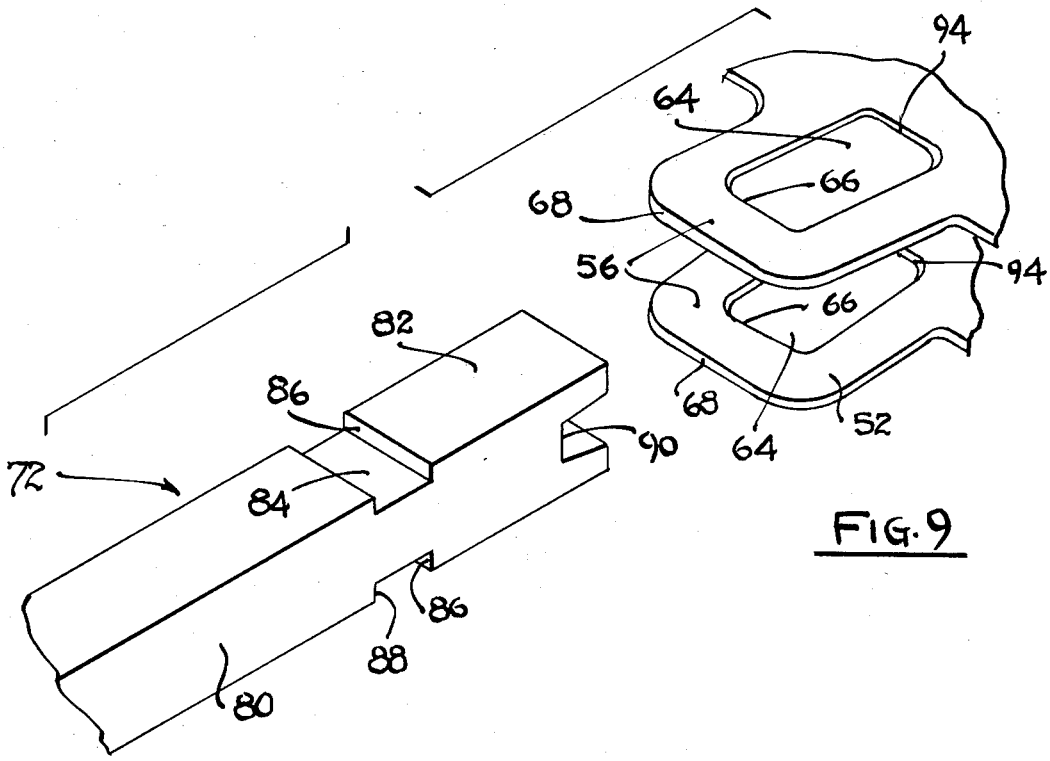
Figure 10:
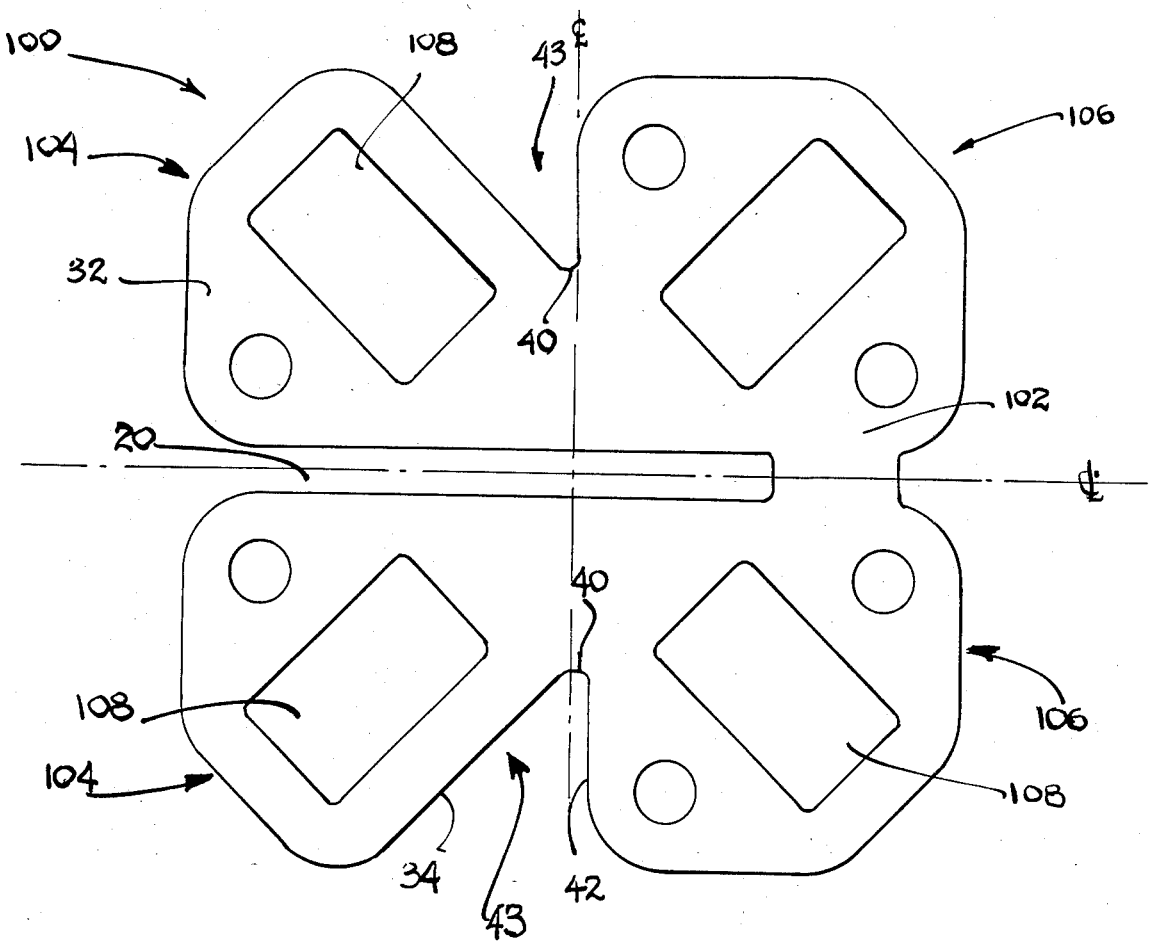
Figure 11:
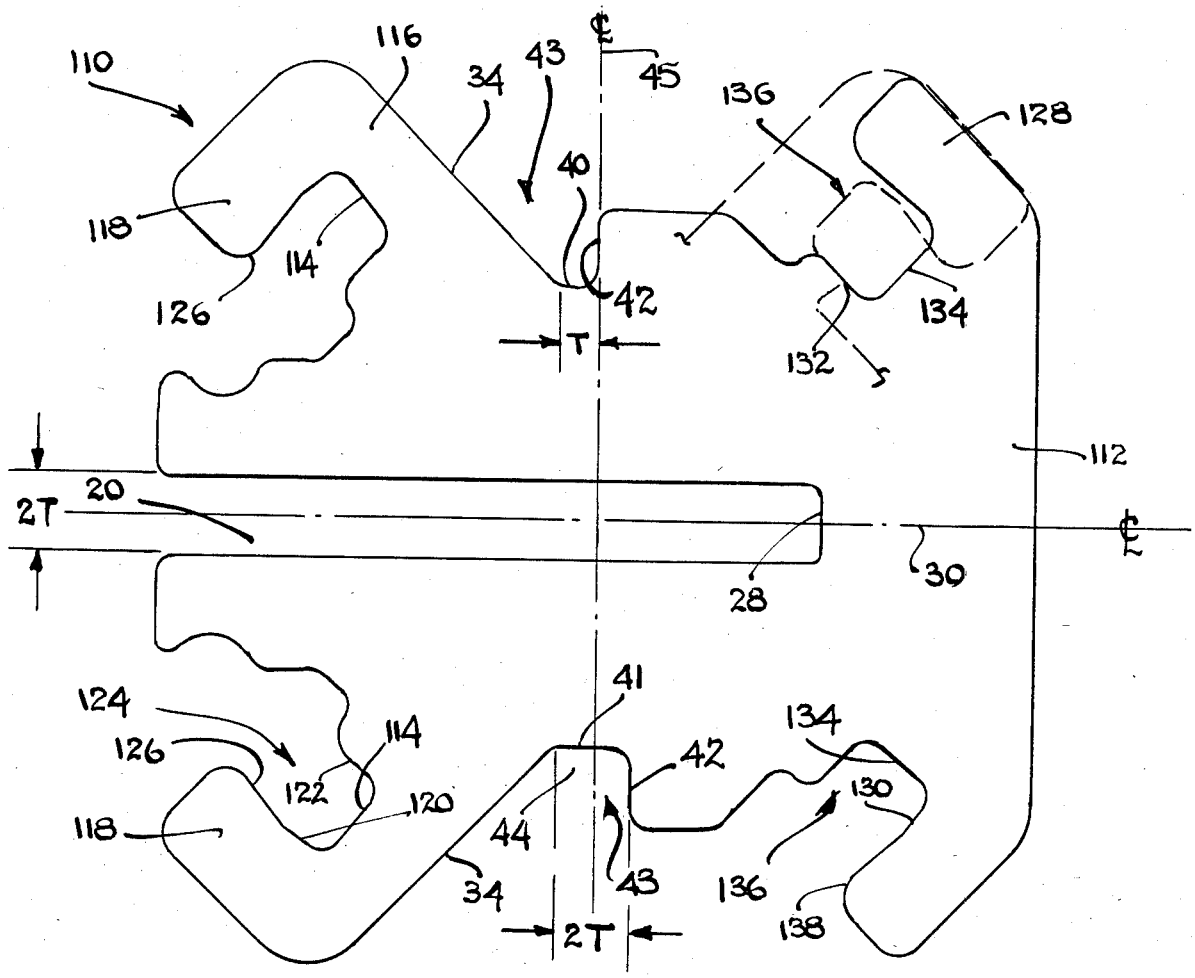
Figure 12:
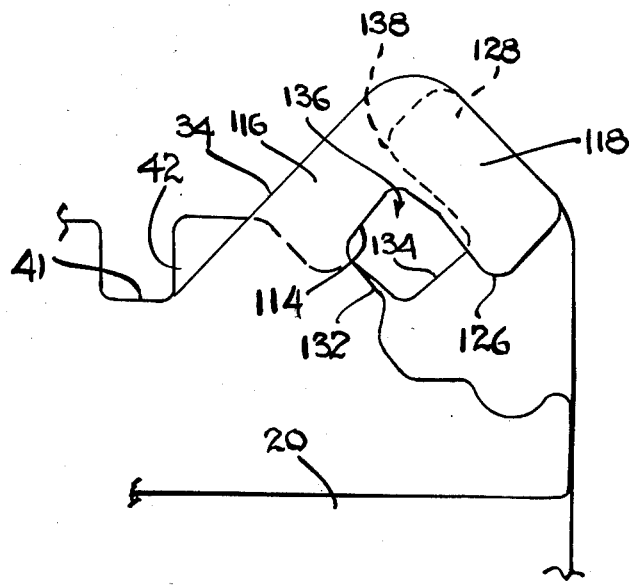
Figure 13:
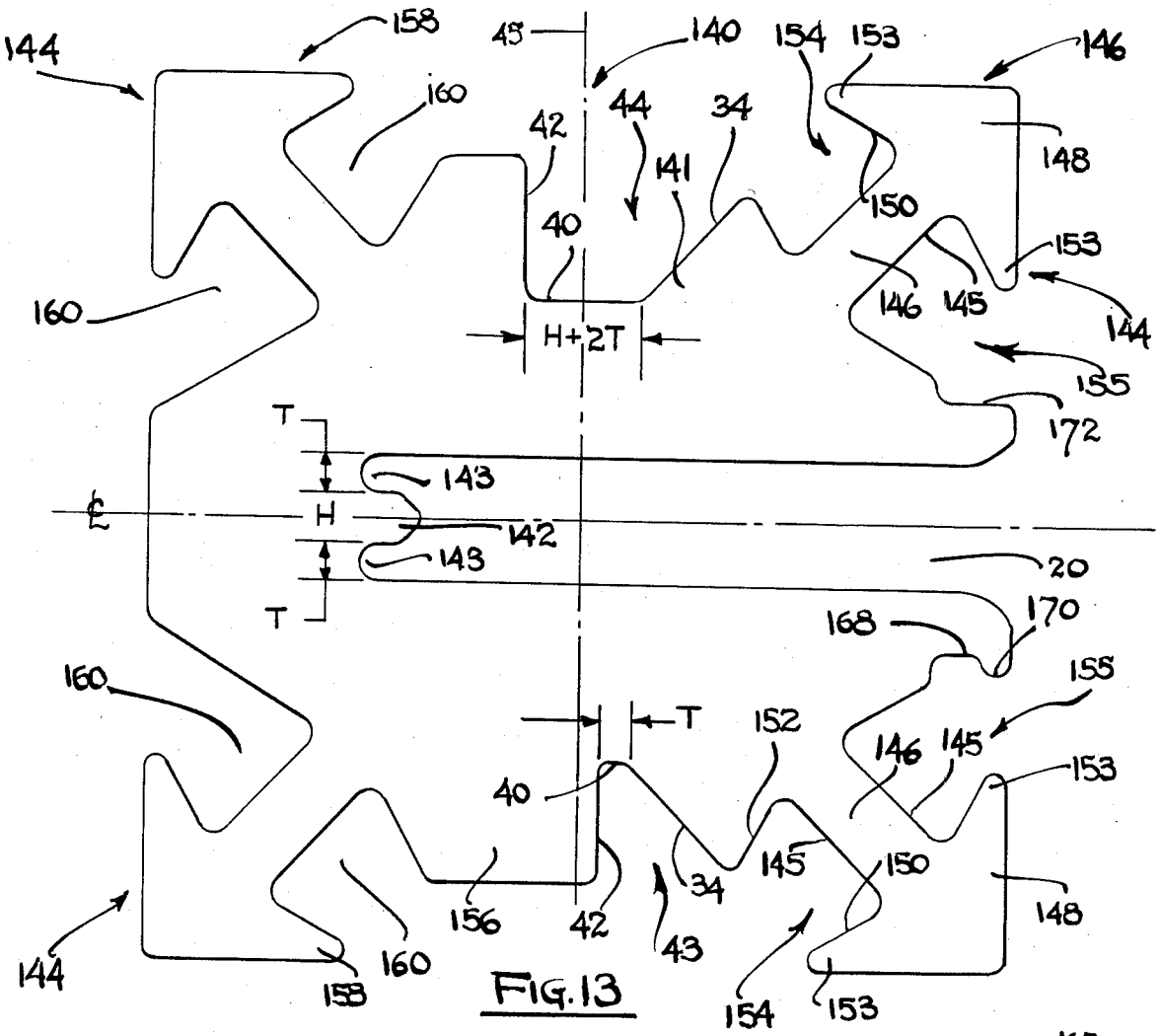
Figure 16:
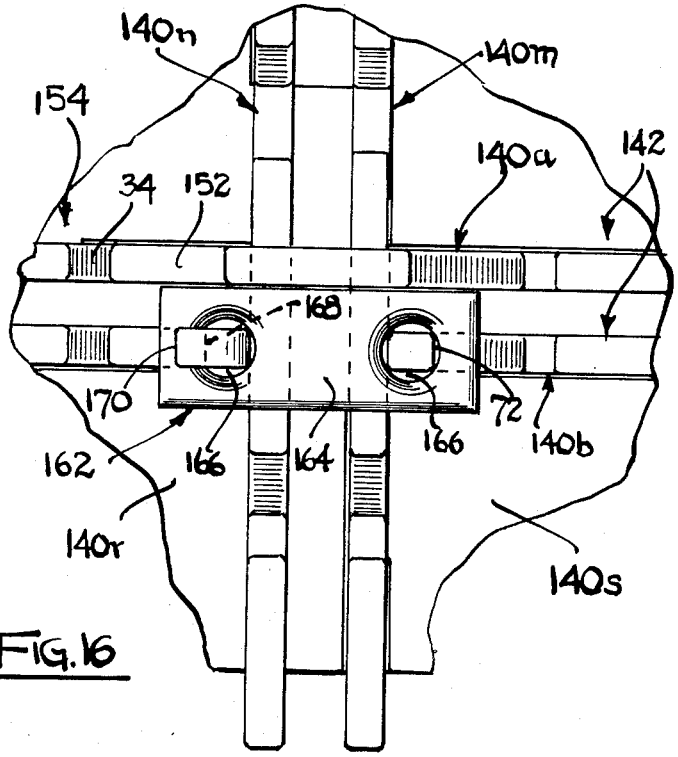
Figure 14:
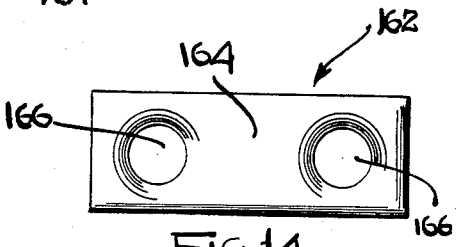
Figure 15:
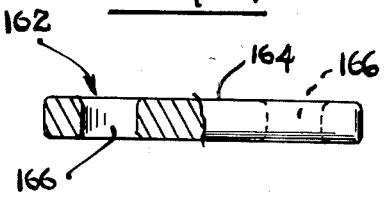
Figure 17:
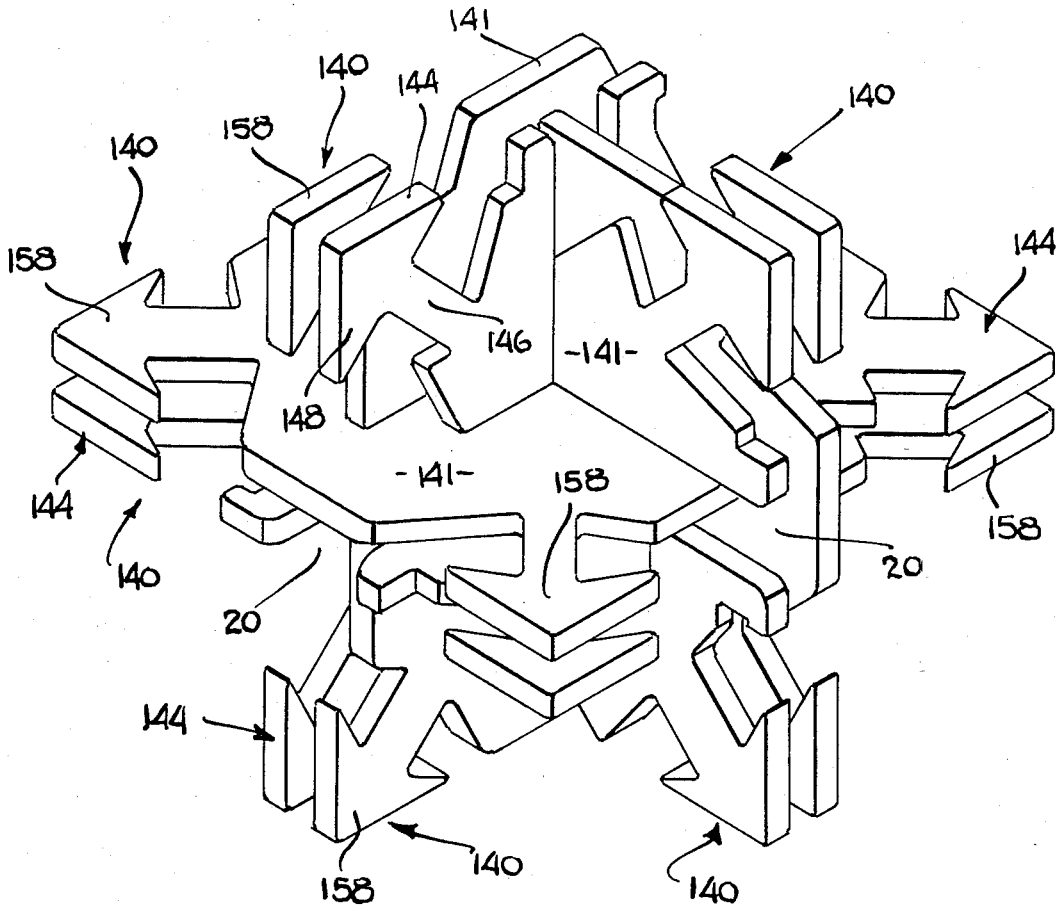
Figure 18:
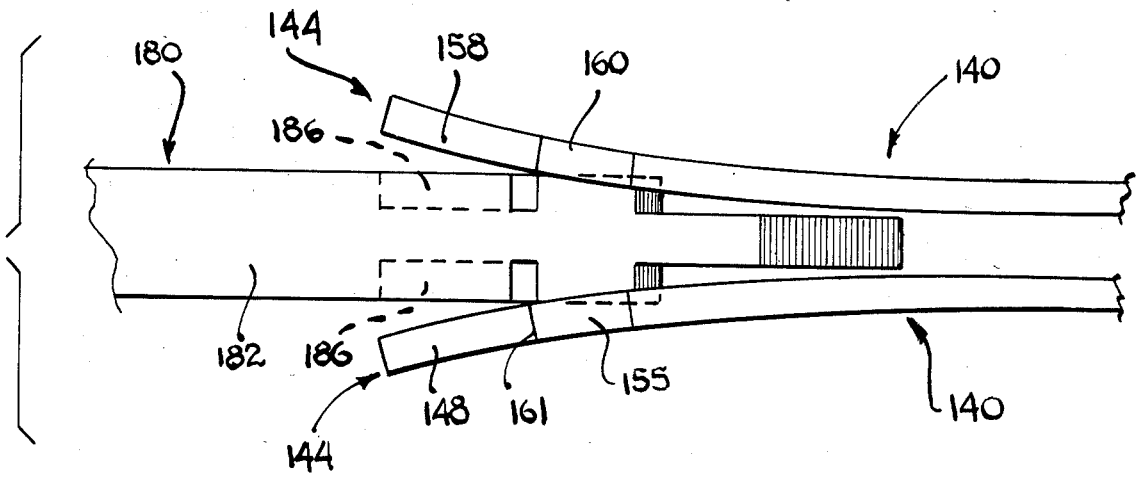
Figure 19:
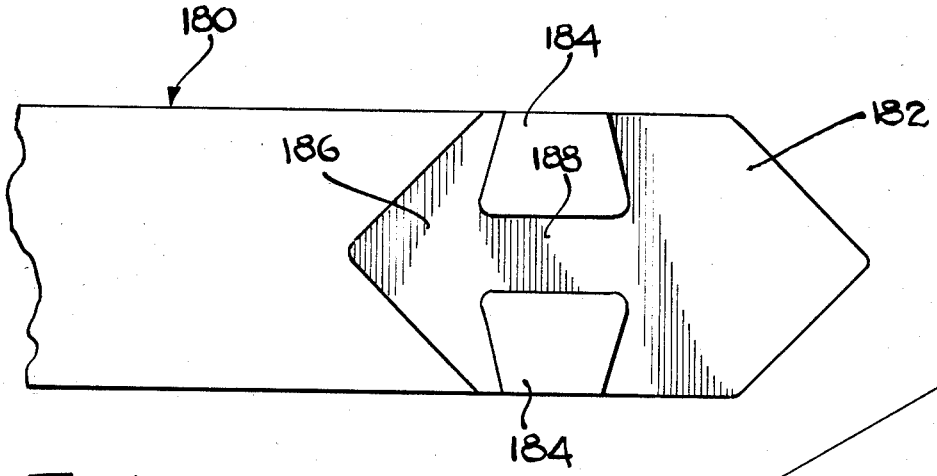
Figure 20:
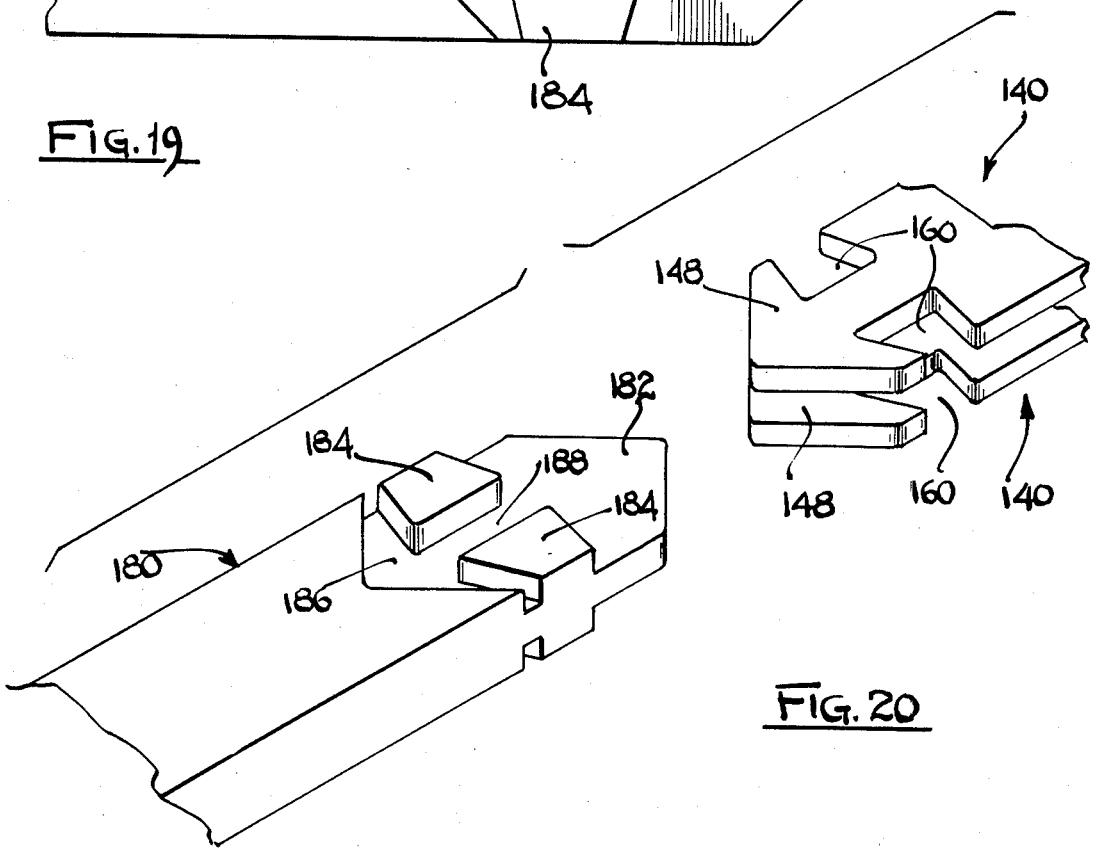

Having thus described the invention in general terms, reference will now be made to the accompanying drawing in which:

FIG. 1 is a schematic illustration showing the relationship of the important portions of a bracket used to form the nodal connector of the present invention;

FIG. 2 is a top plan view of one form of bracket used to construct a nodal connector in accordance with the present invention;

FIG. 3 is an exploded perspective view showing the arrangement of six of the brackets of FIG. 2 immediately prior to assembly thereof;

FIG. 3A is a top plan view of a pair of brackets in facewise disposition as they are initially located at the start of assembly;

FIG. 3E is a top plan view of the brackets of FIG. 3A when the brackets have been moved closer toward their final assembled position during the assembly operation;

FIG. 3C is a top plan view similar to FIGS. 3A and 3B showing the pair of brackets in their facewise disposition when in the fully assembled position;

FIG. 4 is an exploded partially schematic perspective view showing the six brackets of FIG. 3 in a partially but yet uncompleted assembly;

FIG. 5 is a perspective view of the brackets of FIGS. 3 and 4 in a completely assembled relationship to form a nodal connector;

FIG. 6 comprises a group of figures showing one form of structural system which can be created using the nodal connectors and the brackets of the present invention and in which:

FIG. 6A is a top plan view of the structural system;

FIG. 6B is a side elevational view of the structural system taken along the plane of line 6B—6B of FIG. 6A;

FIG. 6C is an end elevational view of the structural system taken along the plane of line 6C—6C of FIG. 6A;

FIG. 7 is a top plan view of a connector means for connecting a strut to a nodal connector of the present invention;

FIG. 8 is a side elevational view of a connector means of FIG. 7 with a strut connected to the nodal connector;

FIG. 9 is an exploded perspective view of the connector means of FIGS. 7 and 8 showing the strut loaded for connection to a nodal connector;

FIG. 10 is a top plan view of a modified form of bracket used to assemble a nodal connector in accordance with the present invention;

FIG. 11 is a top plan view of another modified form of a bracket which may be used to form a nodal connector;

FIG. 12 is a fragmentary top plan view showing a portion of two of the brackets of FIG. 11 in overlying relationship in such manner as to enclose one of the strut connecting apertures thereof;

FIG. 13 is a top plan view with still a further form of bracket which may be used to form a nodal connector of the present invention;

FIG. 14 is a top plan view of a retaining clip used with the brackets of FIG. 13 to form a nodal connector in accordance with the present invention;

FIG. 15 is a side elevational view, partially broken away and in section, of the retaining clip of FIG. 14;

FIG. 16 is a fragmentary top plan view showing the use of the retainer clip in assembling pairs of brackets of the type illustrated in FIG. 13;

FIG. 17 is a perspective view showing a nodal connector assembled from the brackets of FIG. 13;

FIG. 18 is a fragmentary side elevational view of a strut having a modified form of connector end for use with the structural node formed from the brackets of FIG. 13;

FIG. 19 is a top plan view of the connector end of the strut of FIG. 18 and showing its operative connection to a structural node formed of the brackets of FIG. 13;

FIG. 20 is a fragmentary perspective view showing the arrangement of connecting the strut to a nodal connector of the type shown in FIGS. 18 and 19.

Figure 21:
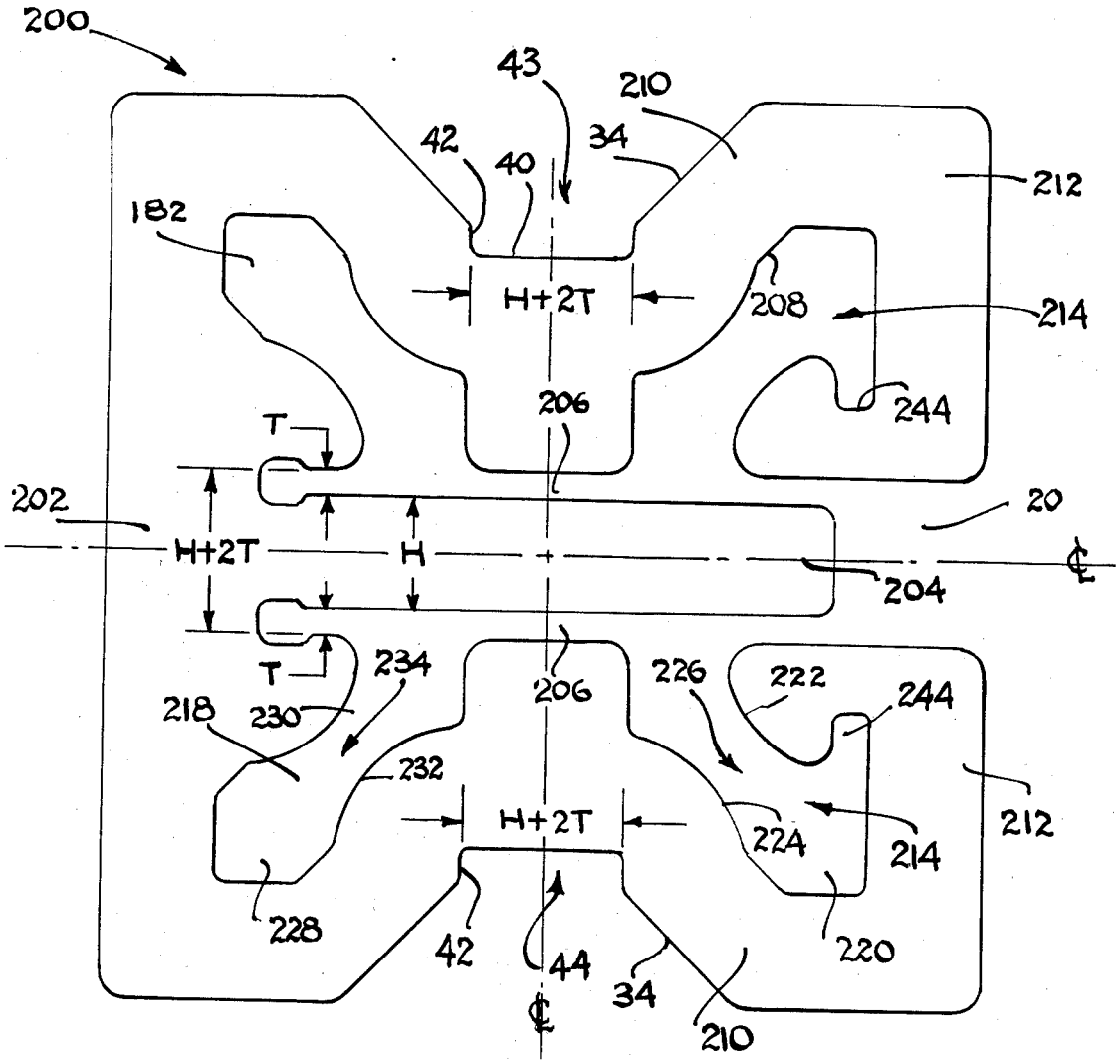
Figure 22:
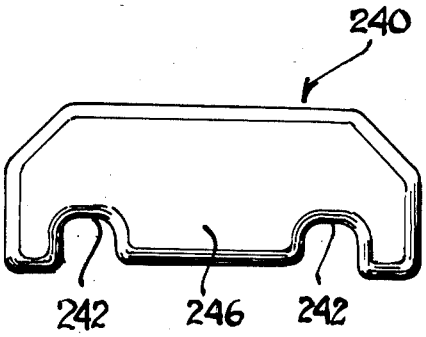
Figure 23:
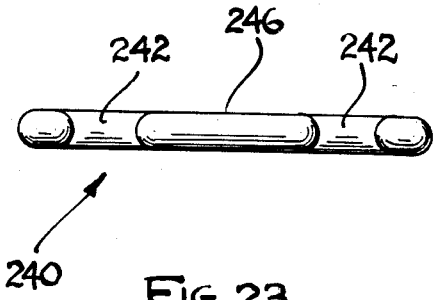
Figure 24:
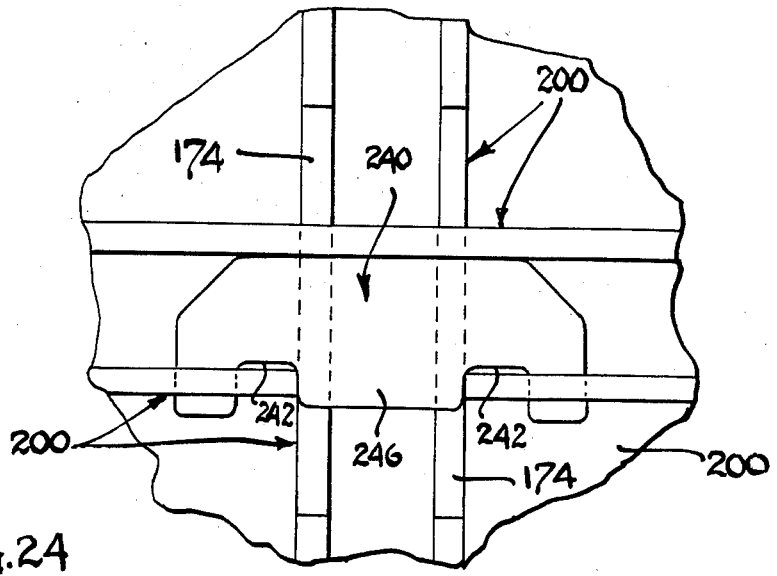
Figure 25:
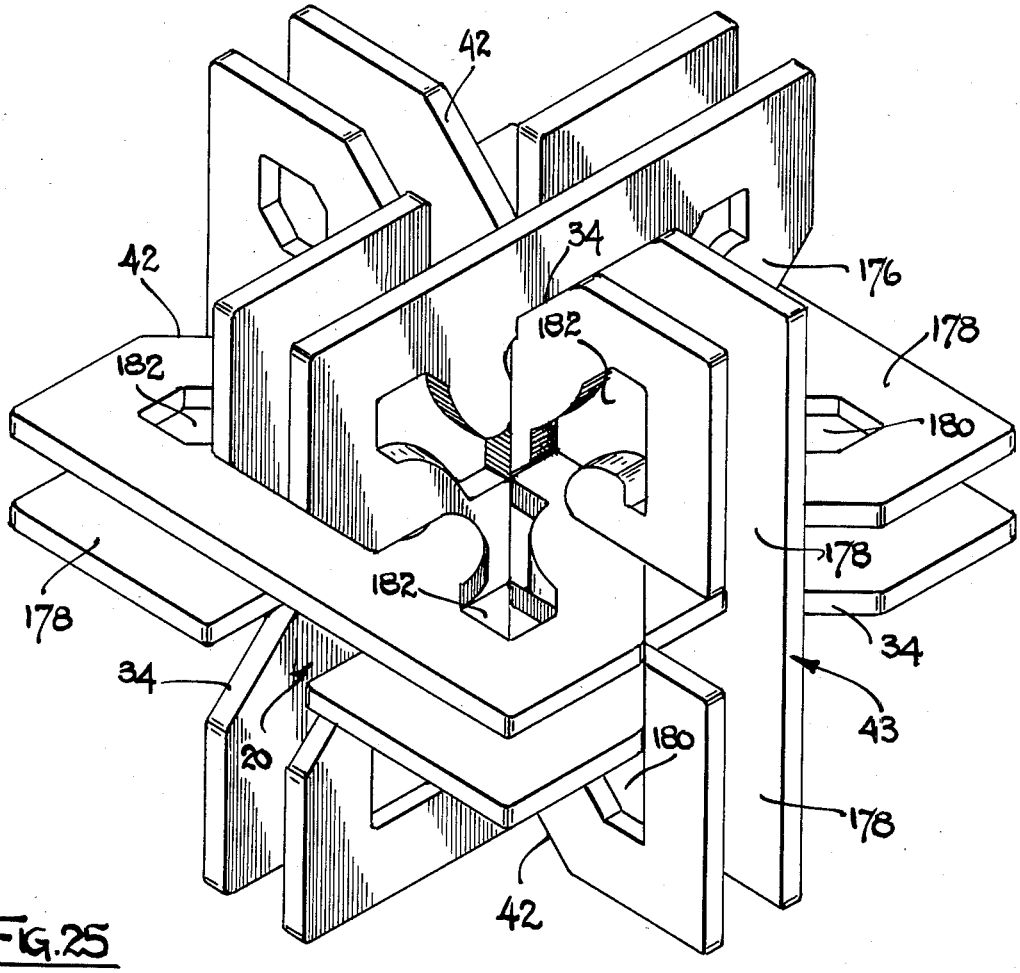
Figure 26:
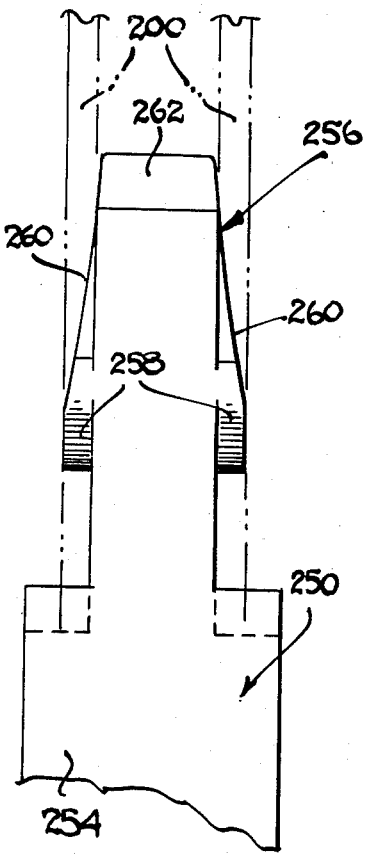
Figure 27:
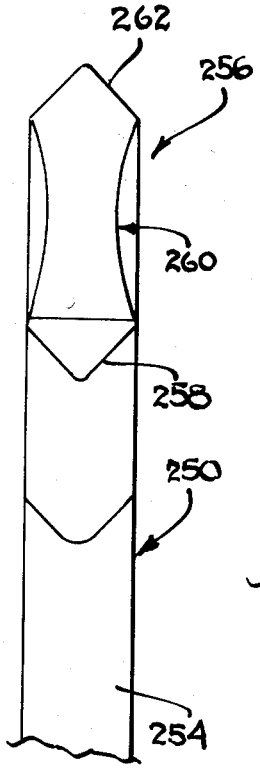
Figure 28:
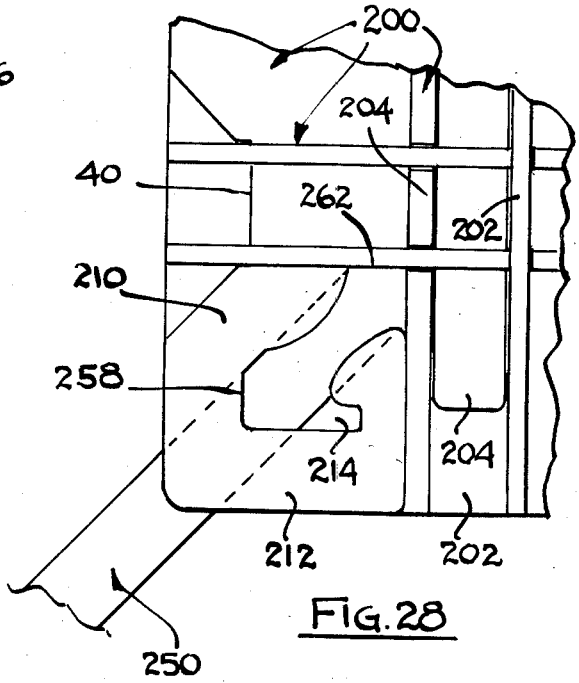
Figure 29:
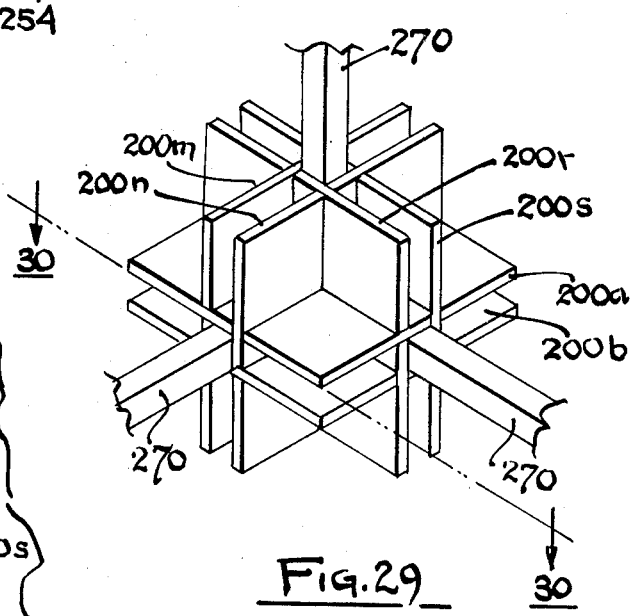
Figure 30:
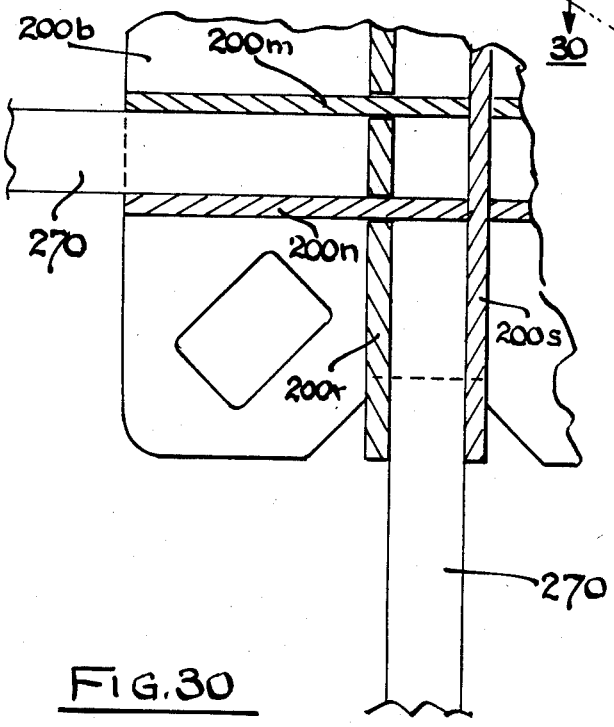
Figure 31:
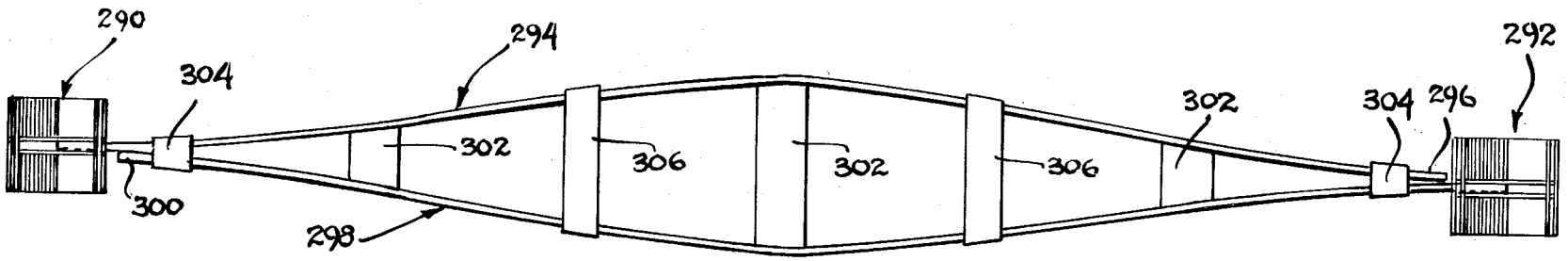
Figure 32:
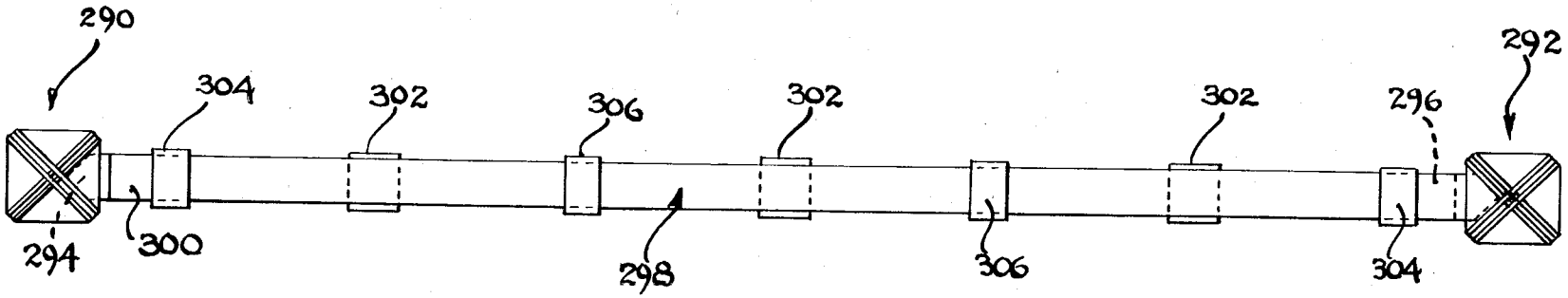

FIG. 21 is a top plan view of still a further modified form of bracket which may be used to form a nodal connector in accordance with the present invention;

FIG. 22 is a top plan view of a modified form of retaining clip for assembling pairs of brackets of the type shown in FIG. 21 to form a nodal connector in accordance with the present invention;

FIG. 23 is a side elevational view of the retaining clip of FIG. 22;

FIG. 24 is a fragmentary top plan view showing the use of the retaining clip of FIGS. 22 and 23 in assembling pairs of brackets of the type illustrated in FIG. 21 as a nodal connector;

FIG. 25 is a fragmentary perspective view of a nodal connector of six of the brackets of FIG. 21 assembled to form a nodal connector;

FIG. 26 is a fragmentary top plan view showing a modified form of connector end forming part of a strut for assembling the strut to a nodal connector;

FIG. 27 is a fragmentary side elevational view of the connector end shown in FIG. 26;

FIG. 28 is a fragmentary top plan view showing the means for connecting a strut having a connnector end as illustrated in FIGS. 26 and 27 to a nodal connector formed of brackets of the type illustrated in FIG. 21;

FIG. 29 is a schematic perspective view of one form of structural system which can be created using the nodal connectors of the present invention with the struts connected in perpendicular relationship;

FIG. 30 is a top plan view, partially in section and taken in the plane of line 30—30 of FIG. 29, of the nodal connector of FIG. 29 showing the struts connected to a nodal connector in a perpendicular relationship;

FIG. 31 is a side elevational view of one arrangement to form a structural system utilizing a pair of struts and a pair of nodal connectors in accordance with the present invention; and FIG. 32 is a bottom plan view of the assembly of FIG. 31.

DETAILED DESCRIPTION OF THE PREFERRED EMBODIMENTS

Referring now in more detail and by reference characters to the drawings which illustrate several practical embodiments of the present invention, FIG. 1 illustrates the overall relationship of important portions of a bracket used to form a nodal connector. The schematic illustration of FIG. 1 is applicable to each of the five types of brackets more fully illustrated in FIGS. 2, 10, 11, 13 and 21. These five types of brackets, illustrated and described herein, are only representative of a large number of brackets which could be used to form nodal connectors in accordance with the present invention. Some of the important criteria for any such bracket is that it should have the overall dimensional relationship as illustrated in FIG. 1 and as hereinafter described.

Each bracket is comprised of an initially relatively flat plate having a thickness T and which is capable of being somewhat resiliently bendable in order to enable connection of a strut, as hereinafter described in more detail. Each plate is comprised of a longitudinally located slot 20 having a pair of opposed longitudinal edges 22 and 24 and which extend from one edge of the plate, such as a front edge 25.

The slot 20 has an opening 26 at that edge of the plate and a rearward or innermost end 28 spaced from that edge 25 having the opening 26 on the plate. Further, the position of the slot 20 is defined by and the longitudinal edges 22 and 24 are equidistantly spaced from a longitudinal center-line 30 at the longitudinal center of the plate. For the purposes of describing the bracket, the edge at which the slot 20 opens may be considered the front edge of the plate and an edge 29 to which the rear or innermost end 28 is closest may be considered the rear edge of the plate. In all embodiments, the slot 20 will have a transverse dimension of at least 2T or two times the thickness of the bracket, plus any space desired between the brackets. In actual practice the thickness of the slot 20 is slightly greater than 2T in any event to accommodate two plates without binding.

Each bracket is provided with four generally quadrilaterally located connection areas or regions and are schematically represented generally by the circular areas 32 in FIG. 1. These regions are generally located at the four corners of a square. They could be located in a rectangular arrangement, but that would distort the octahedral shape of a space frame structural system thus formed. These connection areas represent locations in which a connecting strut may be releasably connected between a pair of plates in a manner hereinafter described in more detail.

Each of the brackets are also provided with outwardly diverging edges 34 on opposite sides of the longitudinal center-line and each of these edges 34 diverge outwardly from the longitudinal center-line 30 at substantially equal angles thereto. Each of the diverging edges 34 have innermost ends 36 (which may also be considered rearwardmost ends) and outermost ends 38 (which may also be considered forwardmost ends). The innermost ends 36 of these diverging edges may merge directly into generally longitudinal extending edges 40 and 41 on opposite sides of the center-line and which are equidistantly spaced from the center-line 30 and are generally parallel to the center-line 30. In certain embodiments of the invention, one longitudinally extending edge 41 has a length greater than the opposite longitudinal edge 40.

Each of the brackets are provided with transversely extending edges 42 on each of the opposite sides of the longitudinal center-line 30 (often referred to as "side edges") and which are essentially perpendicularly located with respect to the longitudinal center-line 30. It can be observed that the longitudinal edges 40 and 41 along with the transversely extending side edges and portions of the diverging edges 34 form notches 43 and 44 on each of the opposite sides of the plate. In FIG. 1, the edge 40 of the notch 43 has a longitudinal dimension of T, namely the thickness of one of the plates. The edge 41 of the notch 44, on the opposite side of the plate has a width of 2T, namely the thickness of two of the plates. If any space was desired between the brackets the length of the edges 40 and 41 and hence the size of the notches would be correspondingly increased. In actuality, the longitudinal dimension T and the longitudinal dimension 2T would be slightly greater than that specified in order to accommodate plates in an interfitting arrangement, as hereinafter described, without any binding effects.

A transverse center-line 45 passes through the side edge 42 forming part of the notch 43 in the manner as illustrated. This transverse center-line 45 bisects the notch 44 and hence the longitudinal edge 41 on the opposite side of the plate. By definition, the transverse center-line 45 is perpendicularly arranged with respect to the longitudinal center-line 30 and is equidistantly spaced between the center-lines of the connection regions 32.

In each of the plates used to form the structural nodes or nodal connectors of the present invention, it is important that the distance between the longitudinal edges 40 and 41 to the longitudinal center-line 30, that is, the distance "X" in FIG. 1 is equal to the distance between the transverse center-line 45 and a plane passing through the innermost end 28 of the slot 20, and which is also represented by the dimension "X" in FIG. 1. It is also important that the dimension between the outermost end 38 of each of the diverging edges 34 and the center-line 30 and which distance is designated by reference letter "Y" in FIG. 1 is equal to the distance between the outermost end 38 of each of the diverging edges 34 and a plane passing through the innermost end 28 of the slot 20, plus the thickness of a plate T and which total distance is designated by "Y plus T" in FIG. 1.

The above described combination of dimensions and relative sizes and angles in each of the brackets enables the plates of each of the six brackets to be interfitted to form a nodal connector which is relatively rigid, but yet with resiliently bendable connector regions, as hereinafter descibed in more detail. These notches are adapted to receive the slots of similar brackets disposed in perpendicular relationship when all brackets of a set are assembled into a node, as hereinafter described in more detail.

Reference numerals representing portions of the bracket as illustrated in FIG. 1, will be used with common portions of the various embodiments of the brackets more fully illustrated and described in detail herein.

The brackets may be formed from a number of known structural materials. For example, the brackets could be cut from wood using a common wood template. Otherwise, they may be formed of any of a number of known moldable plastic materials, such as polyethylene, polystyrene, etc. In addition, they may be formed of fiber reinforced composite materials, such as epoxy-fiberglass composites, various polyester and metal fibers and grown wiskers etc. Further, the brackets may be stamped or otherwise formed of various known metals, such as aluminum, steel, or the like.

While the brackets have been described as being relatively flat, the major structural portion of the bracket, that is the plate itself, is relatively flat. This does not preclude the possibility that the brackets may be formed with stiffeners, such as upstanding flanges or gussets or the like. However, inasmuch as the major component of that bracket which co-acts with other brackets is the flat plate, the brackets themselves, whether or not provided with gussets or ribs, may still be considered to be relatively flat.

FIG. 2 represents one form of bracket 50 which conforms to the criteria set forth in the schematic representation of the bracket of FIG. 1. This bracket 50 comprises a flat plate 51 having the thickness T and which includes the slot 20 having the innermost end 28. The diverging edges 34 of the bracket 50 form the outermost edges of a pair of outwardly diverging sections 52 of the bracket 50. These outwardly diverging sections 52 have inner margins or edges 54 which are generally parallel to the outwardly diverging edges 34 and are connected by somewhat forwardly presented strips 56, in the manner as illustrated. Furthermore, the inner edges 54 merge into the longitudinal edges 22 and 24 of the slot 20, in the manner as also illustrated.

The bracket 50 is also provided with the relatively straight edges 40 and 41 which are parallel to the center-line 30. Further, the dimensions of the straight parallel edges 40 and 41 in the embodiment of FIG. 2 are similar to those in the schematic representation of FIG. 1. Thus, the notch 43 has an overall longitudinal dimension of T and the notch 44 has an overall dimension of 2T. Further, the transverse center-line bisects the edge 41, as shown. The perpendicular outwardly extending side edges 42 of the bracket 50 terminate at points 57 on each of the opposite sides of the bracket and have rearwardly and inwardly converging edges 58. Finally, the rearward portion of the bracket is provided with two outwardly diverging rearwardly extending sections 60 separated by a somewhat relatively short triangular section 62.

The bracket 50 is also provided with the four quadrilaterally located connection regions 32 and which exist in the form of apertures 64 in this embodiment of the bracket. The end strips 56 which close one side of the apertures 64 have inner edges 66 and outer edges 68, as shown. The apertures 64 are not required in all embodiments of the brackets, as will be more fully apparent from the following description of various bracket embodiments.

It can be observed that the bracket of FIG. 2 was formed from an initially generally square shaped flat sheet of material having a peripheral edge 69 as illustrated in FIG. 2. However, portions of the plate forming the bracket have been removed and particularly, the notches 43 and 44, in order to accommodate other brackets in an interfitting arrangement as hereinafter described. In addition, other portions of the plate forming the bracket, as for example, those along the edge 58 have been removed in order to increase flexibility and reduce stiffness. In like manner, rearward portions of the bracket and forward portions of the initially formed square plate have been removed. Thus, it can be observed that the bracket as illustrated in FIG. 2 is very similar to the schematic representation of the bracket in FIG. 1 with portions removed therefrom in order to provide greater flexibility to enable connection of struts as hereinafter described.

When the three pairs of brackets are assembled, as hereinafter described in more detail, they generally form a node capable of being used in an octahedral space frame structure. This specific embodiments of the brackets illustrated and described herein generally produce this same node when assembled, although it should be understood that with a slight modification, other forms of nodes could be created.

It can be observed in accordance with the above that the bracket 50 meets all of the criteria of the bracket illustrated in FIG. 1. When six of the brackets of FIG. 2 are assembled together, in the manner as illustrated in FIGS. 3–5, they will form a structural connecting node 70, as more fully illustrated in FIG. 5. Each of the other brackets, as hereinafter described, when assembled will form a structural node similar to that illustrated in FIG. 5.

A plurality of structural nodes 70 along with struts 72, as illustrated in FIGS. 6A–6C, may be used to form a structural system of the type illustrated. In the structural system as illustrated, it can be observed that struts can be connected to a structural node at an angle of about 45 degrees with respect to two of the three mutually perpendicular planes passing through the interfitted and connected pairs of brackets. It is also possible to connect the struts in other angular relationships, as for example, in a true perpendicular relationship, as hereinafter described in more detail.

It should be recognized that the structure schematically illustrated in FIGS. 6A–6C is only one portion of a structure and is only exemplary of those which can be created using the system of the invention. The struts and structural nodes produced in accordance with the present invention are effective in forming a space frame structural system, that is, a grouping of the nodes and struts in space which are structurally stable as a result of their geometry of construction. Other structures can be made by employing one or more of the nodes provided in accordance with the present invention and one or more struts, which may be the struts provided in accordance with the present invention.

FIGS. 3–5 illustrate the assembly of six of the brackets of FIG. 2, as aforesaid. By reference to FIG. 3, two of the brackets 50 of FIG. 2, designated by **50*a* and 50*b*, constitute a first pair. This first pair of brackets are spaced apart from each other but are disposed in generally opposite but parallel relationship. The longitudinal center-line 30 of each plate 50*a* and 50*b* is in parallel aligned relationship so that the innermost ends 28 of the slots 20 are substantially opposed to each other, as illustrated. A second pair of the plates 50, designated as 50*m* and 50*n* are also located in opposed spaced apart and generally parallel relationship with respect to each other. This second pair of plates 50*m* and 50*n* have their longitudinal slots 20 aligned and with the innermost ends 28 of those slots substantially opposed relative to each other. Further, the second pair of plates 50*m* and 50*n* are perpendicularly located with respect to the first pair of plates 50*a* and 50*b*. Finally, a third pair of the plates 50, designated as 50*r* and 50*s*, are perpendicularly located relative to the first two pairs of plates. These plates 50*r* and 50*s* are also located in opposed spaced apart and generally parallel relationship so that their longitudinal slots are essentially in alignment and the innermost ends of the slots 28** are substantially opposed to each other.

The slots of the plates of each of the pairs and the associated innermost ends of those slots would be in true alignment if the two plates of a pair were in the same plane. However, they are offset from one another by at least a distance equivalent to the thickness of one of the plates. Thus, they are essentially in alignment and have substantially opposed innermost ends.

When the various brackets of FIG. 2 have been assembled to form a structural node, as shown in FIG. 5, the first pair of plates **50*a* and 50*b* will be located in facewise disposition, with the forward most end of plate 50*a* opposed to the rearward end of the plate 50*b*. This relationship is more fully shown in FIG. 3C. One of the flat faces of the plate 50*a* may be in contact with the opposed face of the plate 50*b* or it may be slightly spaced therefrom. The same holds true with respect to the second set of plates 50*m* and 50*n* and finally, the same also holds true of the third pair of plates 50*r* and 50*s*. It can be observed by further reference to FIG. 3C, that when the plates 50*a* and 50*b* are disposed over one another, they form a closed elongate slot having a total length of 2X. This is due to the fact that the distance X between the transverse center line 45 and the plane passing through the innermost end of the slot 28** would be doubled when one plate is facewise disposed upon the other and the rearward ends thereof face outwardly.

Further, when assembling the brackets 50 of FIG. 2 to form a structural node, the two brackets **50*a* and 50*b* will initially be located in facewise engagement with the opposite longitudinal edges of their respective slots in marginal registration. However, as shown in FIG. 3A, the innermost ends 28 of each of these slots will be spaced apart from each other to form an elongate closed slot 74 which has a length greater than the length of either of the slots 20 in each of the plates 50*a* and 50*b*. In fact, the closed elongate slot 74 must have a length at least equal to 2Y. In practice the length of the elongate slot 74 would be slightly greater than 2Y to permit insertion of a pair of perpendicularly located brackets 50*r* and 50*s* into the closed elongate slot 74**.

In like manner, when the two plates **50*m* and 50*n* are located in facewise engagement, the two longitudinal edges of the slots of those plates will be in marginal registration to form an elongate closed slot and which elongate closed slot has a length greater than either of the slots in the respective plates 50*m* and 50*n*** and a length slightly greater than 2Y. The term "elongate closed" slot refers to a slot formed by two facewise disposed brackets and which does not open on any side of the assembly of the brackets as do the slots in each individual bracket, as illustrated.

After the pair of brackets **50*a* and 50*b* have been partially assembled as aforesaid, that is placed in facewise disposition, the pairs of brackets 50*m* and 50*n* are located on opposite sides of the brackets 50*a* and 50*b*. Further, the brackets 50*m* and 50*n* are located at a plane which constitutes a transverse center-line between the ends 28 of the elongate closed slot 74. By reference to FIG. 3A, it can be observed that when portions of the plates are located in the arrangement illustrated, the elongate closed slot has the dimension 2Y and portions of the plates form the 2T dimension, as illustrated. Thus, if the plates 50*a* and 50*b* were in the position as shown in FIG. 3A, the plates 50*m* and 50*n* would be located at the portions of the plates 50*a* and 50*b* having the dimension 2T. When the brackets 50***m* and 50*n* are placed in the position as illustrated in FIG. 4, they are brought together so as to be in the top plan view configuration as shown in FIG. 3A thereby forming a closed elongate slot which accommodates the brackets 50*a* and 50*b*. The brackets 50*r* and 50*s* are also located in aligned, somewhat parallel relationship as shown in FIG. 4. In that position, they are then moved together so that they will be in facewise disposition relative to one another and form a closed elongate slot in the same manner as shown in the top plan configuration of FIG. 3A. In this position, the brackets 50*r* and 50*s* will be received in the elongate closed slot 74 formed by the brackets 50*a* and 50*b* and in addition, the brackets 50*m* and 50*n* will be received in the elongate closed slot 74 formed by the brackets 50*r* and 50*s*. At this point in the assembly, all three pairs have a configuration which is shown in FIG. 3A of the drawings.

To proceed with the assembly, each of the pairs of brackets are further pushed together, generally simultaneously, through a distance Z, so that each pair of brackets assumes a position somewhat similar to that illustrated in FIG. 3B of the drawings. As shown, the distance between two peaks of the plates, initially equal to the dimension 2T, (see FIG. 3), is now equal to 2T plus two times the resultant distance Z after movement, or 2T plus 2Z. Correspondingly, the length of the elongate closed slot 74 has been reduced in each of the three pairs of brackets by a distance 2Z, thus becoming equal to 2Y−2Z, as shown in the drawings.

By further reference to FIG. 3B, it can also be observed that the transverse dimension from the plane represented by reference numeral 76 to the outer edge of the plate, e.g. the plane represented by the reference numeral 77, is also equivalent to the distance Z. Therefore the distance between the planes 76 on the opposite side of the bracket is equal to 2Y−2Z, as shown. This distance 2Y−2Z is important because it corresponds to the length of the closed elongate slot which has now also been reduced to a dimension of 2Y−2Z, as aforesaid.

When each of the pairs of brackets are continuously pushed together, the length of the elongate slot 74 and the distance between the planes 76 on opposite sides of the brackets is reduced in each of the three pairs. This procedure continues until each of the three pairs of brackets assume the relationship as shown in the top plan configuration of FIG. 3C to form the nodal connector 70 as illustrated in FIG. 5 of the drawings. By further reference to FIG. 3C, it can be observed that the elongate slot 74 finally is reduced to a dimension of 2X and the planes 76 will be moved closer together until they merge with the edges 40 and 41, which also have a distance therebetween of 2X. By close examination of FIG. 1 and FIG. 3C, it can be observed that this dimension 2X is required for each pair of brackets so that each one pair of brackets will fit within the closed elongate slots of the other pairs, as shown. It should be understood that when the brackets are assembled into a nodal connector, no one bracket or no pair of brackets can be pulled apart and outwardly of the nodal connector individually, without movement of the other brackets. Thus, all three pairs of brackets must be moved essentially almost simultaneously and by essentially the same successive incremental amounts in order to separate the three pairs. In like manner, all three pairs of brackets must be effectively pushed together in the same way when assembling the node. When a simple strut is connected, there can be no inadvertent disassembly of the node.

FIGS. 7–9 illustrate the connection of a strut to the connector regions 64 of the assembled mode. As hereinbefore stated, the plates which form part of each bracket in a nodal connector are relatively rigid even though portions thereof are capable of some degree of displacement. More specifically, the outwardly extending portions of the connection regions are displaceable. Furthermore, this displacement occuring at the periphery, does not affect the integrity and rigidness of the central portions or the node. The degree of displacement necessary is permitted by the use of notches, holes, or narrower portions, or the like.

Each of the struts 72 preferably comprises an elongate bar 80 having a substantially similar connection end 82 at each of the opposite ends of the bar. Each connection end 82 is provided with transverse slots 84 on a pair of opposite faces thereof, such as upper and lower faces, as illustrated in FIGS. 7 and 9. The slots 84 provide forwardly presented lips 86 and opposed rearwardly presented lips 88 and are adapted to engage and connect to the pairs of apertures 64 in the brackets, as illustrated in FIGS. 7 through 9. The connection ends 82 are provided on their transverse ends with somewhat U-shaped notches 90 which are adapted to engage the two spread apart plates at the innermost portions 94 of the apertures 64.

When the planes of two of the brackets 50 are spread apart, and particularly in the connection regions, the connection ends 82 of the struts will snap-fit into apertures in or formed at these connection regions. Thus, when the outwardly extending sections 52 and the outwardly extending sections 60 are spread apart, the connection end 82 will fit within the corresponding apertures 64. By resiliently spreading the two connection areas 64 apart, the end strip 56 on each opposed plate will fit into the slots 84 when the plates are allowed to resiliently snap back toward their original position. The lip 86 on each of the opposite faces of the strut will engage the edge 66 and the lip 88 will engage the edge 68 of the aperture 64 thereby retentively holding the strut 72 to the connection regions 32 in one of the pairs of plates. The notch 90 will engage margins 94 of each aperture 64.

It can be noted, that the displacement of the end portions of the connection regions helps maintain the strut tightly within the connection region without impairing the nodes ability to resist the structural forces to which it is subjected. More specifically, compressive forces are transmitted directly to the central portion of the node from points 94 without affecting the outward portions of the connection regions at all, while tensile forces which are resisted first at these outwrd portions actually tend to further tighten the joint, rather than loosen the same. It can be observed that a strut cannot be removed from the nodal connector until such time as the two plates and particularly the outwardly extending elements 52 or 60 are spaced apart to enable the removal of the connection end 82 from the associated apertures 64.

FIG. 10 illustrates a modified form of bracket 100 which may also be used to form a structural node in accordance with the present invention. The bracket 100 similarily includes a flat plate 102 having the elongate slot 20 and the four quadrilaterally located connection regions 32 which exist in the form of apertures 108. In addition, the bracket 100 is provided with the diverging edges 34 and the outwardly extending perpendicularly located edges 42.

It can be observed that the bracket 100 as illustrated in FIG. 10 is very similar to the bracket 50 as illustrated in FIG. 2, except that the bracket 100 provides a greater material surface area. In other words, more material has been removed from the bracket 50 of FIG. 2 then in the bracket 100 of FIG. 10. The bracket 100 also includes two forwardly located end sections 104 and two rearwardly located end sections 106 and all of which are quadrilaterally located, as shown. Each end section includes the aperture 108. While the four quadrilaterally located end sections have a slightly different shape, compared to previous embodiments, they are still equivalent to the four quadrilaterally located outwardly extending sections 52 and 60 in the bracket 50. Furthermore, six of the brackets 100 would be assembled much in the same manner as six of the brackets 50, as illustrated in FIGS. 3–5 of the drawings.

The assembled structural node or nodal connector from six of the brackets 100, specifically three pairs of the brackets 100, would also provide a structural node which permits connection of the struts much in the same manner as illustrated in FIGS. 7–9 of the drawings. Thus, the connection end 82 of a strut would extend into the apertures 108 formed between pairs of spaced apart plates in the structural node.

FIG. 11 illustrates another form of bracket 110 which may be used to form a structural node or nodal connector in accordance with the present invention. The bracket 110 also includes a relatively flat plate 112 having the elongate slot 20 as well as the outwardly diverging edges 34, as illustrated. The outwardly diverging edges 34 are connected to relatively straight edges 40 on each of the opposite sides of the slot 20. Further, these relatively straight edges 40 merge into transversely extending side edges 42 which are essentially perpendicular to the longitudinal edges of the slot 20 and thereby form notches 43 and 44, in the same manner as in the schematic representation of the bracket in FIG. 1.

While the bracket 110 does not initially provide four enclosed apertures, such as the apertures 64, representing or designating connection regions, as in the previous embodiments of the brackets, there are nevertheless four connection regions. The diverging edges 34 along with corresponding parallel outwardly diverging edges 114 form outwardly extending arms 116 and which are provided with reversely bent hook-like elements 118. The hook like elements project toward a center-line passing through the slot 20 and have inner edges 120 which are spaced from approximately parallel edges 122 on the body of the plate 112. The edges 114, 120 and 122 thereby define three sides of rectangularly shaped openings 124 to receive the connector ends of struts. The edges 120 merge into somewhat of an arcuate shoulder 126 at the outer ends of the arms 116 and which project into the openings 124. The bracket 110 is also provided at its rearward end with a pair of outwardly diverging arms 128. These outwardly diverging arms 128 each have an outwardly diverging, but somewhat inwardly presented edge 130 and which edges 130 are parallel to corresponding edges 132 spaced from the edges 130 on the body of the bracket, as illustrated. These parallel edges 130 and 132, along with a rearwardly presented edge 134 form three sides of an opening 136. The edge 130 integrally merges into a shoulder 138 extending toward the edge 132 and serves the same function as the shoulder 126. This opening 136 effectively operates in the same manner as the opening 124 in that when it is completely closed, as hereinafter described, it permits the connection end of a strut to be connected thereto or dis-connected and removed therefrom.

When two of the brackets 110 are assembled in the form of a pair much as the brackets **50*a* and 50*b* or the pair of brackets 50*m* and 50*n*, one of the brackets 110 will overlie the other of the brackets 110 although the front edge of one will be in essentially a marginal registration with the rearward edge of the other. In this way, each one of the hook-like elements 118 on the forward edge of one bracket coact with each one of the outwardly diverging arms 128 on the rear of the other of the brackets. In like manner, each one of the outwardly diverging arm 128 of the second of the brackets will cooperate with the hook-like elements 118 on the forward end of the first named bracket. Thus, and in this way, each of the openings 124 at the forward end of one of the brackets are closed by the outwardly diverging arms 128 at the rearward end of the other of the brackets, much in the manner as shown in FIG. 12. In like manner, the openings 136 at the rearward end of one of the brackets is fully closed by the hook-like elements 118 of the other of the pair of the brackets. In this way, while the openings in the brackets 110** are initially closed only on three sides, the assembled relationship of a pair of the brackets provides four fully enclosed connection apertures.

Struts of the type illustrated in FIGS. 7 through 9 may also be connected to the connection regions of these pair of brackets much in the same manner as in the pairs of brackets 50. The brackets 110 are merely spread apart at the connection regions to enable a connector end of the strut to be inserted in or removed from these connection apertures. Additionally, when the brackets 110 are spread apart, a closed loop may be inserted in the aperture then rotated to form a secure base for tension forces and the like.

FIG. 13 illustrates another modified form of bracket 140 which may be used to form a structural node in accordance with the present invention. The bracket 140 is also comprised of a flat plate 141 having an elongate slot 20 provided with an inner end 28. The inner end 28 of the slot 20 is provided with a relatively small forwardly projecting divider 142 which effectively divides the rearward portion of the slot into a pair of plate receiving sections 143 on opposite sides of the divider 142. The plate receiving sections 143 are each sized to receive an individual plate of a pair so that the plates of such pair would be in spaced apart facewise disposition. The bracket 140 also includes the oppositely disposed notches 43 and 44 formed of the edges 34, 40 and 42.

By further reference to FIG. 13, it can be observed that the divider 142 has a dimension H and the plate receiving sections 143 would each have a dimension of T, namely the thickness of any one plate or bracket. Consequently, the slot 20 has an overall transverse dimension, as measured along the axial center line 45 of H plus 2T. The notch 43 has a dimension of T whereas the notch 44 on the upper side of the bracket is illustrated in FIG. 13 has a dimension of H plus 2T. Further, it can be observed that the edge 42 forming part of the notch 43 is not located at the transverse center-line 45, but rather, is spaced to the right of the transverse center-line 45 by a dimension of $\frac{1}{2}$ H. This permits a pair of brackets 140 to be offset from each other while in facewise disposition, in a manner as hereinafter described in more detail.

The bracket 140 further comprises a pair of arrow-like members 144 each having a pair of parallel outwardly diverging edges 145 defining boundaries of outwardly extending arms 146 and which merge at their outer ends into an element 148 having the shape of an arrowhead, and thus the elements 148 are referred to as "arrowheads" 148. Each arrowhead has a pair of rearwardly presented edges 150 which are oblique to and cooperate with like edges 152 on the body of the bracket. It can be observed that the edges 150 and 152 along with the diverging edges 145 form a pair of openings 154 and 155 on each of the forwardly presented opposite sides of the bracket to receive the connection end of a strut.

The bracket 140 is similarly provided with the generally longitudinally extending edges 40 which are parallel to the longitudinal edges of the slot 20. Further, the bracket 140 is provided with outwardly extending sections 156 and one of the edges of each of these sections 156 are the outwardly extending side edges 42.

At its rearward end, the bracket 140 is also provided with outwardly extending arrow-like members 158 to the arrow-like members 144. Furthermore, these arrow-like members 158 co-act with the main body of the bracket to provide openings 160.

FIGS 14 and 15 illustrate a retaining clip or so-called "keeper" 162 which is used with the brackets 140 to increase tensile strength in the assembled relationship, as more fully illustrated in FIGS. 15 and 16. The keeper 162 is comprised of a generally flat plate 164 having a pair of apertures 166 extending therethrough.

The brackets 140 are provided with a keeper receiving recess 168 on one side of the elongate slot 20 and provided with a hook 170 in the manner as illustrated. One of the apertures 166 is adapted to extend over the hook 170 and to engage the recess 168. The opposite aperture 166 of the keeper, 162 is adapted to extend over and engage a shoulder or so-called "flat" 172 on the opposite side of the elongate slot 20, also in the manner as shown in FIGS. 13 and 16.

FIGS. 16 and 17 illustrate the assembled relationship of three pairs of brackets 140 and including a first pair of brackets **140*a* and 140*b*, a second pair of brackets 140*m* and 140*n* and a third pair of brackets 140*r* and 140*s*. It can be observed that a keeper 162 is adapted to engage the hook recess 168 on one of the brackets 140*b* and extend over the flat shoulder 172 on the same bracket and in this way, engages the pair of brackets 140*m* and 140*n*. In like manner, a similar keeper 162 is connected to similar hooks and shoulders on the brackets 140*m* and 140*n* to engage the brackets 140*r* and 140*s*. These keepers 162 provide continuity across the slots 20** for increased capacity of the node to resist tension forces.

FIG. 17 is a perspective view illustrating a portion of three pairs of the brackets of FIG. 13 in the fully assembled relationship to form a structural node. The brackets 140 are similarly assembled in three pairs, much in the same manner as three pairs of brackets 50 were assembled. However, the brackets 140 are not disposed in facewise engagement, but rather, they are located in spaced apart facewise disposition with respect to one another. Further, in the assembled relationship, each of the brackets 140 of each pair remain in spaced apart facewise disposition. Thus, one bracket **140*a* will remain in spaced apart but parallel and facewise disposition to a counter part cooperating bracket 140*b* of a first pair. Similarly, a bracket 140*m* will remain in spaced apart parallel facewise disposition to another cooperating bracket 140*n*** of that second pair.

The spaced apart facewise disposition of pairs of brackets 140 in a finally assembled structural nodal connector enables the use of a substantially thicker bracket than in the previously described embodiments. This is due to the fact that lesser displacement is required when inserting and removing a strut. Thus, and in this sense, the brackets can be considered when in the assembled condition, to be partially pre-displaced. This form of connecting node produced by the brackets of FIG. 13 is highly effective for use in large structures. Further, it provides a greater degree of rigidity and structural support. Beyond this, the node of FIG. 17 is formed essentially in the same manner as the node 70 in FIGS. 3–5. It is also diassembled much in the same manner as the previously described nodal connectors.

FIGS. 18 through 20 illustrate a modified form of strut 180 which is used with the connecting node formed of the brackets 140. This strut 180 is comprised of an elongate bar 182 having a pair of opposite connector ends 184. The connector end 184 of the strut 180 is provided with an arrowhead shaped recess 186 on each of the opposite sides thereof and an elongate recess 188 connected to the arrowhead recess 186. This arrangement is effective in allowing the arrowhead 148 of the arrow-like members 144 and the arrow-like members 158 to be inserted in the recesses 186 and 188. Further, it can be observed that the rearward edges 150 of the arrowhead 148 and the forwardly presented edges 152 will engage portions of the recesses in the struts to retentatively retain the strut within the spaced apart brackets 140. The struts 180 can only again be removed by displacing the brackets slightly, much in the manner as illustrated in FIG. 18.

The nodal connector thus produced from the brackets of 140 permits the use of a substantially larger strut. This again also permits a much stronger combination of nodal connector and strut for use in large structures.

FIG. 21 illustrates a further modified form of a bracket 200 which may be combined with similar brackets to form a structural node in accordance with the present invention. The bracket 200 is similarly formed of a relatively flat plate 202 having oppositely disposed relatively flat surfaces and includes a slot 20 extending through a portion of the plate. However, an elongate arm or divider 204 projects from the innermost end 28 of the slot and extends through a substantial portion of the slot, in the manner as illustrated in FIG. 21. The arm 204 does not otherwise affect the operation of the slot 20 and provides a pair of oppositely disposed bracket receiving sections 206 on opposite sides of the divider 204, similar to the bracket 140 of FIG. 12. Thus, individual plates of a pair will be fitted within the slot 20 on opposite sides of the separating arm or divider 204 so that the brackets are spaced apart in the final assembled relationship, much in the same manner as the brackets in the node of FIG. 17. The arm 204 is also effective in compensating for compression loading. In absence of the arm 204, buckling or bending of the brackets might occur under compression loading due to their separation.

The bracket 200 also includes the longitudinally extending edges 40 which are parallel to the longitudinal edges of the slot 20. In addition, the brackets 200 includes a pair of outwardly diverging edges 34 and relatively short side edges 42. These edges 34, 40 and 42 form the notches 43 and 44 on opposite sides of the bracket, as shown. In this embodiment of the brackets, the notches 43 and 44 are substantially the same size.

The diverging edges 34 cooperate with another pair of spaced apart edges 208 to form outwardly projecting arms 210. These arms are connected to somewhat U-shaped sections 212 thereby providing a pair of forwardly located openings 214 functioning as the connection regions. Here again, it can be observed that while the plate 202 of the bracket 200 has a somewhat different appearance than the previously described brackets, it nevertheless operates much in the same manner as the previously described brackets and is also capable of being assembled with three pairs thereof to form a structural node.

At its rearward end, the bracket 200 is also provided with elongate openings 218 which also function as connection regions much in the same manner as the openings 214 at the forward portion of the bracket. Here again, the openings are not fully closed, although they can function to connect with the connector end of a strut and disconnect from the connector end of the strut, as hereinafter described in more detail.

It can be observed that the slot 20 in the embodiment of the bracket 200 has an overall dimension of H plus 2T, with H being the transverse dimension of the arm 204. Further, it can be observed that each of the notches 43 and 44 similarly have a longitudinal dimension of H plus 2T. Again, in actual practice, the notches would have a dimension slightly greater than H plus 2T to allow for non-binding clearance.

Each of the openings 214 are characterized by an enlarged section 220 having arcuate shoulders 222 and 224 projecting into the openings 214 thereby defining narrow regions 226. This shoulder is designed to maintain the desired cross-sectional width of the arm 210 as it is located adjacent to the notch. Finally, the openings 218 also have an enlarged open position 228 with shoulders 230 and 232 projecting into the openings thereby defining narrow regions 234. Thus, the enlarged opened portions 220 and 228 serve as the primary connector openings to receive a strut, as hereinafter described in more detail.

FIGS. 22 and 23 illustrate a retaining clip or so-called "keeper" 240 which may be used to increase the tensile capacity of the brackets 200 in the assembled position. FIG. 24 more fully illustrates the use of the retainer clip 240 in holding the brackets 200 in the assembled position. In each case, the retainer clip is provided on one edge with a pair of notches 242 which are capable of extending into recessed area 244 in the bracket 200 as shown in FIG. 21. In this way, the various brackets are held in the assembled position in a structural node. The retaining clip or keeper is initially inserted into the recesses 224 and turned 90 degrees so that they is effectively lay in flat facewise disposition one of the brackets. It can be observed that a flange 246 separated by the notches 242 lays on the opposite side of the bracket to which the clip is secured.

FIG. 25 is a perspective view showing three pairs of the brackets 200 in FIG. 21 assembled in the form of a structural node. The various pairs of brackets are located in spaced apart, parallel and facewise disposition and are not abutted together in facewise engagement. Nevertheless, the structural node of FIG. 25 functions much in the same manner as the previously described structural nodes. This structural node of FIG. 25, much like the structural node of FIG. 17, also provides a greater degree of rigidity and structural support due to the fact that the brackets in each pair are slightly spaced apart from one another and due to the fact that the plates of the brackets have a thicker cross-section T.

A strut 250 which is adapted for use with a nodal connector of the type illustrated in FIG. 25 and formed from the bracekts 200, is more fully illustrated in FIGS. 26 and 27 and the connection end of that strut 250 connected to the nodal connector is illustrated in FIG. 28. The strut 250 is comprised of an elongate bar 254 having a connector end 256 which is uniquely adapted for connection to the openings 220 and 228. The connector end 256 is provided with rearwardly presented shoulders 258 on opposite surfaces thereof and which are adapted to bear against portions of the brackets forming the openings 220 or 228. Furthermore, the connector end 256 is provided with arcuate side walls 260 on each of the opposite sides thereof which are adapted to fit within the shoulders 222 and 224 at the openings 214 and fit within the shoulders 230 and 232 at the opening 218. Further, the outermost end of the connector end 256 is provided with a tapered edge 262 which is adapted to engage a corner portion of two of the brackets located in perpendicular relationship as illustrated in FIG. 28.

The type of connection of a strut to a nodal connector provides for a fairly secure and fairly rigid construction. Moreover, the strut can be formed of a fairly thick bar only with a reduced portion at the connector end. This nodal connector also offers the advantages of the previously described nodal connector formed of the brackets 140 which form the nodal connector of FIG. 17. These advantages include at least the fact that the plates forming the brackets can be formed of a substantial thickness and since they are located in spaced apart relationship, they can be fairly rigid. Furthermore, they are adapted to receive a strut having a substantial thickness and rigidity.

It can be observed that each of the brackets can be assembled in the form of three pairs to create a structural node without the need of any mechanical fasteners such as bolts or the like. Furthermore, the connecting struts can be connected to each of the structural nodes without the need of bolts or other forms of mechanical fasteners. Due to the fact that each of the brackets can be formed of identical sizes and shapes, the cost of manufacture of each of these brackets is materially reduced. Further, problems of storage and transport are minimized.

As indicated previously, when the three pairs of brackets are assembled to form a nodal connector, and with each bracket containing four quadrilaterally located connection regions, the nodal connector itself will provide twelve connection regions. Four of those connection regions will exist in one plane with the second four of the connecting regions quadrilaterally arranged in a second plane mutually perpendicular to the first. A third set of the four quadrilaterally located connection regions will lie in a plane mutually perpendicular to the first two planes. In this way, twelve struts could be connected and with each strut essentially connected at a 45 degree angle to the planes of the brackets in the nodal connector.

It is also possible to connect struts to the nodal connector in three mutually perpendicular planes. This type of arrangement is more fully illustrated in FIGS. 29 and 30 of the drawings. In this case, it can be observed that a strut 270 can be connected at the intersection of two pairs of the plates, as for example, between the plates of brackets 200*a* and 200*b* and 200*r* and 200*s*. In like manner, a second nodal connector could be connected at the junction of plates of brackets 200*a* and 200*b* and 200*m* and 200*n*. A third nodal connector could be connected to the junction of brackets 200*m* and 200*n* and 200*r* and 200*s* as shown in FIG. 29. Three additional struts could also be connected to the opposite junctions of each of these sets of brackets. Thus, it can be observed that six additional connection areas are provided such that the struts can be removeably secured to a nodal connector in mutually perpendicular planes in space.

The brackets 200 in FIGS. 29 and 30 are only illustrated schematically. Further, any of the brackets of the present invention could abe used with struts connected in perpendicular relationship. The struts 270 are also shown without connector ends, although suitable connector ends could be provided or they could be retained in the nodes with fasteners or the like.

The structural nodes and the struts of the present invention are highly effective in making a spaced column structure. As used herein, the term "spaced column structure" refers to a structure in which a pair of struts extending between common nodes may have portions spaced apart from one another, but which function as a strut having a greater cross-sectional thickness than the two struts combined. In addition, the use of a spaced column structure permits a strut to be connected to any of the nodes in a structural system and disconnected from any of these nodes in a structural system without displacing any of the nodes relative to one another. This is a highly advantageous feature in that the structural integrity of an entire structure can be maintained while replacing one or more struts and does not require the disassembly of a portion or the entire structure itself.

FIGS. 31 and 32 more fully illustrate the use of the nodal connectors and the struts to form a spaced column structure. In the illustrated embodiment, a pair of nodal connectors 290 and 292 are provided and are similar to any of the other previously described connectors. Preferably, those nodal connectors using spaced apart brackets, e.g. those of FIGS 17 and 25 are effective in the spaced column structures. A first strut 294 similar to any of the previously described struts has one end connected to the nodal connector 290. The other end of the strut terminates in close proximity but is not connected to the nodal connector 292. A second strut 298, similar to the previously described strut 294, has one end connected to the nodal connector 292 and an opposite end 300 which terminates in close proximity to but is not connected to the nodal connector 290. The two struts 294 and 298 would normally lie in facewise engagement with each other, but are separated intermediate their ends by a plurality of spacers or separaters 302. As the distance from any one connector to the midpoint of the two struts increases, the separaters 302 become somewhat larger, in the manner as illustrated in FIG. 31. In this way, the two struts 294 and 298 are spaced apart from each other and function as a spaced column. The end 296 of the strut 294 is disposed in facewise engagement near the end of the strut 298 connected to the nodal connector 292 and is held in such position by means of a strap or loop 304. The end 300 of the strut 298 is disposed in facewise engagement with one surface of the strut 294 in proximity to the nodal connector 290 and is retained in that position by means of a similar strap or loop 304. The remaining portions of the struts 294 and 298 are biased towards each other and against the spacer blocks 302 by means of similar straps or loops 306. In this way, the spacer blocks 302 separate portions of the two struts and the various loops or straps 304 and 306 bias the struts toward each other.

It has been found that this arrangement using two struts with the nodal connectors enables the spaced column construction. Thus, the spaced column effectively provides the strength of a strut having the thickness of the two struts in their spaced apart relationship but yet with substantially less material and with substantially less costs.

Thus, the illustrated and described structural system fulfills all of the objects and advantages sought therefore. It should be understood that many changes, modifications, variations and other uses and applications will become apparent to those skilled in the art after considering this specification and the accompanying drawings. Therefore, any and all such changes, modifications, variations and other uses and applications, which become apparent to those skilled in the art, after considering this specification and the accompanying drawings, are deemed to be covered by the invention which is limited only by the following claims.

Having thus described my invention, what I desire to claim and secure by Letters Patent is:

1. A three dimensional nodal connector for securing one or more struts extending between the nodal connector and another like nodal connector, said nodal connector comprising:

(a) six flat plates and each of said plates capable of being identical in size to one another and each having identical peripheral and interior shapes, (b) each of said plates being shaped for enabling said plates to be interfitted together as three pairs in three substantially mutually perpendicular planes relative to one another and with the plates of each pair being facewise disposed to one another to form a relatively solid and relatively rigid three dimensional nodal connector, and (c) connection means on each of said plates forming connection regions in each of said pairs in said three substantially mutually perpendicular planes to enable struts to be removeably connected to said nodal connector.

2. The nodal connector of claim 1 further characterized in that said plates each comprise longitudinally oriented slots and transversally oriented side notches which enable each of said plates of one pair to be interfitted together with plates of the other pairs in said three dimensional nodal structure.

3. The nodal connector of claim 2 further characterized in that said nodal connector has twelve connection regions which are quadrilaterally located for connection of struts thereto, each said region comprising an opening to receive an end of a strut.

4. The nodal connector of claim 3 further characterized in that each of said connection regions on one pair of plates are at approximately 45 degree angles relative to the planes of the two other pairs of plates in the nodal connector.

5. The nodal connector of claim 4 further characterized in that at least six additional connection regions are available on said nodal connector for connection of six additional struts in a mutually perpendicular arrangement relative to one another and each one being within parallel to the planes of at least one of the pairs of plates.

6. The nodal connector of claim 4 further characterized in that the interior portions of the plates which include the connection regions comprises apertures surrounded by peripheral deflectable portions that are capable of being resiliently spread apart so that each may receive a strut therebetween and each said strut having an attachment end for connection to each of said plates, and which attachment ends have projections capable of extending into said connection apertures.

7. The nodal connector of claim 4 further characterized in that two connection regions are located forwardly of said transverse center-line, each of said connection regions being on opposite sides of said longitudinal center-line, said plate having two other connection regions located rearwardly of said transverse center-line on opposite sides of said longitudinal center-line, said connection regions being oriented to attach struts thereto at 45 degree angles to said longitudinal and transverse center-lines.

8. The nodal connector of claim 7 further characterized in that a first pair of plates comprise generally parallel facewise disposed plates and which second pair of plates is substantially perpendicular to said first pair of plates and said third plates are substantially perpendicular to both said first pair and said second pair of plates.

9. A relatively flat substantially square bracket capable of being assembled with five additional identical brackets to form a node, said bracket comprising:

(a) a relatively flat plate having a pair of oppositely disposed relatively flat surfaces defining a plate of a specified thickness, said plate having a longitudinal center-line and a transverse center-line, (b) said plate having an elongate slot extending parallel to and divided by said longitudinal center-line, said slot having a width slightly greater than two of said plate thicknesses and a length approximately equal to the width of a plate and opening at one edge of said plate and ending at a point spaced from the other opposite edge by a distance equal to approximately to 174 of a plate width, (c) outwardly diverging edges on said plate which diverge outwardly at approximately 45 degree angles in the direction toward the edge of the plate in which the elongate slot opens, (d) each of said diverging edges having innermost ends proximate to said transverse center-line and being substantially equidistantly spaced from the longitudinal center-line by a dimension approximately equal to $\frac{1}{4}$ of a plate width, each of said diverging edges also having outermost ends on the bracket edges which are substantially equidistantly spaced from said transverse center-line, (e) said diverging edges forming a side of each of a pair of transversely spaced apart notches on each side of said plate, (f) the distance between the transverse center-line to the plane passing through the innermost end of said elongate slot being equal to the distance between the innermost ends of said diverging edges to the longitudinal center-line, and (g) the distance between the outermost ends of each of said diverging edges to the longitudinal cenerline being approximately equal to the distance between the outermost ends of said diverging edges to a transverse plane passing through the innermost end of said elongate slot plus the thickness of one plate.

10. A structural system comprised of at least two spaced apart nodal connectors and at least one strut connected between each of said nodal connectors, said system comprising:

(a) a pair of spaced apart nodal connectors, each of said connectors comprising three pairs of generally parallel facewise disposed plates of substantially identical interior and exterior size and shape and each pair of the parallel plates being interfitted with and generally perpendicular in space to each of the other pairs of plates, and each of the pairs of plates providing a plurality of connection regions for connection of struts thereto, said plates also being somewhat resiliently displaceable in the connection regions, and (b) at least one connecting strut extending between at least each of two nodal connectors, each connecting strut having an end at each nodal connector which is capable of being snap-fitted between the two parallel facewise disposed plates of that connector and retentively but nevertheless releaseably retained therein.

11. The structural system of claim 10 further characterized in that the means for enabling said plates to be interfitted together in substantially mutually perpendicular planes to form a three dimensional nodal connector comprise elongate centrally located longitudinal slots and transversely located side notches with outwardly diverging edges which diverge outwardly form such side notches.

12. The structural system of claim 10 further characterized in that the interior portions of the plates which include the connection regions comprise apertures with peripheral deflectable portions that are capable of being resiliently spread apart so that each may receive a strut therebetween and each said strut having an attachment end for connection to each of said plates, and which attachment 13. A relatively flat and somewhat resiliently bendable bracket capable of being assembled with a plurality of similar brackets to form a structural node, said bracket comprising:

(a) a relatively flat plate having a pair of oppositely disposed relatively flat surfaces defining a plate of a specified thickness said plate having a longitudinal center-line and a transverse center-line and at least two connection regions to enable connection of struts when a plurality of said brackets are assembled into a connecting node, (b) means forming an elongate slot in said plate and extending along said longitudinal center-line, said slot opening at one edge of said plate and having an innermost end thereof spaced from said edge, (c) a pair of opposite outwardly diverging edges on said plate which diverge outwardly from said longitudinal center-line at substantially equal angles, and from said transverse center-line at substantially equal angles, (d) each of said diverging edges having innermost ends proximate to said slot and being substantially equidistantly spaced from the longitudinal center-line, each of said diverging edges also having outermost ends distal to said slot and being substantially equidistantly spaced from the longitudinal center-line, (e) means forming a pair of transversely spaced apart notches on said plate and at least one of said notches contacting said transverse center-line, (f) the distance between the transverse center-line to the plane passing through the innermost end of said slot being equal to the distance between the innermost ends of said diverging edges to the longitudinal center-line, and (g) the distance between the outermost ends of each of said diverging edges to the longitudinal center-line being approximately equal to a dimension which is the distance between the outermost ends of one of said diverging edges to a plane passing through the innermost end of said slot plus the thickness of any one plate.

14. The bracket of claim 13 further characterized in that said plate provides four quadrilaterally located connection regions when a plurality of said plates are assembled into a connecting node and that three pairs of said plates provide at least twelve connecting regions when assembled into a connecting node.

15. The bracket of claim 13 further characterized in that said two connection regions are located forwardly of said innermost end of said slot and proximate to the slot opening at one edge, each of said connection regions being on opposite sides of said longitudinal center-line, said plate having two other connection regions located rearwardly of said innermost end of said slot on opposite sides of said longitudinal center-line.

16. The bracket of claim 13 further characterized in that the innermost ends of the diverging edges are equidistantly spaced from said longitudinal center-line, the outermost ends of said diverging edges on each of the opposite sides of said plate being equidistantly spaced from said longitudinal center-line, said outwardly diverging edges being equiangularly located with respect to said longitudinal center-line.

17. The bracket of claim 13 further characterized in that an outwardly projecting side edge and a longitudinaly extending edge cooperate with the outwardly diverging edge on each of the opposite sides of the plates to form said notches on each of the sides of the plate, said transverse center-line passing through and bisecting at least one of said notches.

18. The bracket of claim 17 further characterized in that said slot has a thickness of at least two plates and is located with respect to said center-line.

19. The bracket of claim 18 further characterized in that one of said notches has a thickness of at least two plates.

20. The bracket of claim 19 further characterized in that the other of said notches have a thickness of one plate.

21. The bracket of claim 14 further characterized in that each of said quadrilaterally located connection regions comprise an aperture formed in said bracket and which aperture is closed on all sides.

22. The bracket of claim 14 further characterized in that each of said quadrilaterally located connection regions comprise an opening in the bracket which is not fully closed but which opening comprises a fully closed connector aperture when another like bracket is disposed thereover.

23. The bracket of claim 13 further characterized in that a solid section divider is located in said slot and extends along said longitudinal center-line toward the opened end thereof.

24. A system of a plurality of substantially identically sized and shaped relatively flat and somewhat resiliently bendable brackets with each capable of being assembled to provide a structural node, said system comprising:

(a) a first pair of relatively flat plates having a pair of oppositely disposed relatively flat surfaces, each said plate of said first pair having at least four generally quadrilaterally located connection regions to enable connection of struts, when said plates are assembled into a connecting node, each of said first pair of plates having an elongate slot with each said slot opening at one edge of each of said plates and each slot having an innermost end thereof, each said slot of said first pair of plates being defined by a pair of longitudinally extending edges and which slots are parallel to and bisected by a longitudinal center-line, each of said plates of said first pair having edges which diverge outwardly from said longitudinal center-line at substantially equal angles, and from a transverse center-line at substantially equal angles, (b) a second pair of relatively flat plates and which are substantially identical in size and shape to said first plates, each plate of said second pair having a pair of oppositely disposed relatively flat surfaces and each said plate of said second pair having at least four generally quadrilaterally located connection regions to enable connection of struts, when said plates are assembled into a connecting node, each of said second pair of plates having an elongate slot in said plates with each said slot opening at one edge of each of said plates and having innermost ends therof, each said slot of said second pair of plates being defined by a pair of longitudinally extending edges and which slots are parallel to and bisected by a longitudinal center-line, each of said plates of said second pair having edges which diverge outwardly from said longitudinal center-line at substantially equal angles and from a transverse center-line at substantially equal angles, and (c) a third pair of relatively flat plates which are substantially identical in size and shape to said first and second pairs of plates, each plate of said third pair having a pair of oppositely disposed relatively flat surfaces and each said plate of said third pair having at least four generally quadrilaterally located connection regions to enable connection of struts when all of said plates are assembled into a connecting node, each of said third pair of plates having an elongate slot in said plates with each said slot opening at one edge of one of said plates and each said slot having an innermost end thereof, each said slot of said third pair of plates being defined by a pair of longitudinally extending edges and which slots are parallel to and bisected by a longitudinal center-line, each of said plates of said third pair having edges on said third plates which diverge outwardly from said longitudinal center-line at substantially equal angles and from a transverse center-line at substantially equal angles, and each of said pairs of plates capable of being assembled in mutually perpendicular planes in space by certain of the pairs of plates fitting in corresponding slots in others of the pairs of plates.

25. The bracket of claim 24 further characterized in that the outermost ends of said diverging edges of each plate to the longitudinal center-line of such plate is represented by the distance Y and the distance between the outermost ends of said diverging edges of said plate to a plane passing through the innermost end of said slot is approximately equal to the distance Y plus T, where T is the plate thickness.

26. The bracket of claim 25 further characterized in that the distance between the innermost ends of at least one of said diverging edges to said plane passing through the innermost end of said slot on each said plate being approximately equal to the distance between the innermost end of said diverging edges to a longitudinal center-line of such plate.

27. The bracket of claim 26 further characterized in that each of said pairs of plates when in their assembled relationship provide fourquadrilaterally located connection regions and that said node provides at least twelve connection regions.

28. The bracket of claim 27 further characterized in that two of said connection regions of each pair of plates are located forwardly of said innermost end of said slot and are proximate to the slot opening at one edge and being on opposite sides of said longitudinal center-line, the other two of said connection regions of each of said pairs being located rearwardly of said innermost end of said slot on opposite sides of said longitudinal center-line.

29. The bracket of claim 26 further characterized in that an outwardly projecting side edge and a longitudinally extending edge cooperate with the outwardly diverging edge on each of the opposite sides of the plate to form notches on each of the sides of the plate, said transverse center-line passing through and bisecting at least one of said notches.

30. A system of a plurality of relatively square and flat brackets capable of being assembled to provide a structural node, said system comprising:

(a) a first pair of relatively flat plates having a pair of oppositely disposed relatively flat surfaces, each said plate of said first pair having an elongate slot parallel to and divided by by a longitudinal center-line with said slot opening at one edge of each plate of said first pair and having innermost ends thereof, one of the plates of said first pair capable of being located in opposed facewise disposition to the other so that the slots in each plate form a first elongate closed slot with a first common center-line and where the innermost ends of each of said slots are substantially opposed to each other, the length of said elongate slot being initially greater than the dimension of the slot in each of said plates of said first pair and being initially greater than the transverse dimension of a plate, (b) a second pair of relatively square and flat plates having a pair of oppositely disposed relatively flat surfaces, each of said plates of said second pair of plates having an elongate slot parallel to and divided by a longitudinal center-line with said slots opening at one edge of each of said plates of said second pair and having innermost ends thereof, one of the plates of the second pair capable of being located in opposed facewise disposition to the other so that the slots in each of the plates of the second pair form a second elongated closed slot with a second common center-line and where the innermost ends of each of said slots in said second pair of plates are substantially opposed to each other, the length of said second elongate slot being initially greater than the dimension of each slot in each of said plates of said second pair, and being initially greater than the transverse dimension of a plate, the second pair of facewise disposed plates capable of being inserted in the elongate slot formed by the first pair of plates and being substantially perpendicularly located with respect to the first pair of plates, (c) a third pair of relatively square and flat plates having a pair of oppositely disposed relatively flat surfaces, each of said third pair of plates having an elongate slot parallel to and divided by a longitudinal center-line with each said slot of said third pair of plates opening at one edge of said plates and having innermost ends thereof, one of the plates of the third pair capable of being located in opposed facewise disposition to the other when all plates are assembled into a node so that the slots in each plate form a third elongate closed slot with a third common center-line, and where the innermost ends of the slots in said third pair of plates are substantially opposed to each other, the length of said third elongate slot being initially greater than the length of the slots in each of said plates of said third pair and being initially greater than the transverse dimension of a plate, and where said third pair of plates are sized to be inserted into the elongate slot formed by said second pair of plates and at the same time encompassing and introducing said first pair of plate into its own said third elongate slot and such that all three pairs of plates are substantially perpendicularly located with respect to each of the other pairs of plates, each of said pairs of plates further being assembled by pushing each plate of each pair so that the length of the elongate slots become progressively reduced and each pair of said plates fits snugly within the receiving elongate slots of another pair whereby each of said plates are assembled in mutually perpendicular planes in space by certain of the pairs of plates fitting in corresponding elongate slots in others of the pairs of plates.

31. The system of claim 30 further characterized in that each plate of said pairs has at least four generaly quadrilaterally located connection regions to enable connection of struts, and said node has twelve such connection regions.

32. The system of claim 31 further characterized in that each of said plates of each of said pairs have edges which diverge outwardly from the longitudinal center-line of that pair at substantially equal angles.

33. The system of claim 32 further characterized in that the distance between the outermost ends of said diverging edges to the longitudinal center-line of a plate being approximately equal to the distance between the outermost ends of the diverging edges of such plate to a plane passing through the innermost end of the slot of that plate plus the thickness of the plate.

34. The system of claim 33 further characterized in that the distance between a transverse center-line of each plate to a plane passing through the innermost end of that slot of that plate being approximately equal to the distance between the innermost ends of said diverging ends to the longitudinal center-line of that plate.

35. The bracket of claim 9 further characterized in that said plate provides four quadrilaterally located connection regions and that three pairs of said plates provide at least twelve connection regions when assembled into a connecting node, said connection regions providing means for connection of struts thereto for the interconnecting of said node with other like nodes.

36. The bracket of claim 35 further characterized in that two connection regions are located forwardly of said transverse center-line, each of said connection regions being on opposite sides of said longitudinal center-line, said plate having two other connection regions located rearwardly of said transverse center-line on opposite sides of said longitudinal center-line, said connection regions being oriented to attach struts thereto at 45 degree angles to said longitudinal and transverse center-line.

37. The bracket of claim 36 further characterized in that each of said quadrilaterally located connection regions comprise an opening in the bracket which is not fully closed but which opeing comprises a fully closed connector aperture when another like bracket is disposed thereover.

38. The bracket of claim 36 further characterized in that each connection region comprises an aperture which is closed on three sides and opens into said elongate slot.

39. A node formed by assembling the plate of claim 35, said node comprising:

(a) each plate of a first pair of plates being disposed in facewise but generally opposed and slightly offset relationship wherein the distance between the opposing closed ends of the elongate slots is greater tha the overall plate width, and the distance between the opposing ends of the now overlapping outwardly diverging edges is greater than two plate thickness, (b) each plate of a second pair of plates being disposed in the same facewise but opposed and slightly offset generally overlapping relationship, (c) the second pair of plates while in such partial ovelapping relationship being inserted into the elongate slot or slots of the first pair of plates, (d) each plate of a third pair of plates in the same facewise but opposed and slightly offset relationship being individually inserted into the elongate slots in the second pair of plates, thereby allowing the first pair of plates to enter the slots in said third pair as they are being inserted and overlapped, whereas the closed ends of each elongated slot is proximate to the corresponding outwardly diverging side edges, and (e) each of the plates of the first pair being pushed into greater overlapping relationship and each of the plates of the second pair being pushed into greater overlapping relationship and each of the plates of the third pair of plates being pushed into greater overlapping relationship so that the distances between the closed ends of each opposing elongate slot is becoming reduced as correspondingly the outwardly diverging side edges are in overlapping relationship and each closed end of each elongate strut is proximate to the inner end of the corresponding transversely spaced notch formed by said outwardly diverging side edges and each plate of each pair is generally overlapping the other plate of that pair.

40. The bracket of claim 35 wherein the side edges of the elongate slot are spaced substantially further apart than two plate thicknesses and said outwardly diverging side edges begin at a point ½ of said substantial distance further from said transverse center-line and said longitudinal center-line.

41. The bracket of claim 40 wherein a space between the side edges of the elongate slot is occupied by a divider tongue extending from the closed end toward the open end of said elongate slot.

* * * * *